US012624510B2

(12) United States Patent
Yano

(10) Patent No.: US 12,624,510 B2
(45) Date of Patent: May 12, 2026

(54) ANCHOR

(71) Applicant: CREATIVE SYSTEMS Co., Ltd., Shizuoka (JP)

(72) Inventor: Hideki Yano, Shizuoka (JP)

(73) Assignee: CREATIVE SYSTEMS Co., Ltd., Shizuoka (JP)

( * ) Notice: Subject to any disclaimer, the term of this patent is extended or adjusted under 35 U.S.C. 154(b) by 183 days.

(21) Appl. No.: 18/284,447

(22) PCT Filed: Feb. 1, 2022

(86) PCT No.: PCT/JP2022/003841

§ 371 (c)(1),
(2) Date: Sep. 27, 2023

(87) PCT Pub. No.: WO2022/219883

PCT Pub. Date: Oct. 20, 2022

(65) Prior Publication Data

US 2024/0159010 A1 May 16, 2024

(30) Foreign Application Priority Data

Apr. 14, 2021 (JP) ..... 2021-068196

(51) Int. Cl.
*E02D 5/80* (2006.01)
*E02D 27/50* (2006.01)

(52) U.S. Cl.
CPC ..... *E02D 5/80* (2013.01); *E02D 27/50* (2013.01); *E02D 2200/1607* (2013.01); *E02D 2600/20* (2013.01); *E02D 2600/30* (2013.01)

(58) Field of Classification Search
CPC ... E02D 5/80; E02D 27/50; E02D 2200/1607; E02D 2600/20; E02D 2600/30;
(Continued)

(56) References Cited

U.S. PATENT DOCUMENTS 759,759 A * 5/1904 Shepard et al. ..... E02D 5/801 52/157
3,736,711 A * 6/1973 Thornbrugh ..... E02D 5/801 52/157

(Continued)

FOREIGN PATENT DOCUMENTS

JP 2000178969 A 6/2000
JP 2012246703 A 12/2012

(Continued)

OTHER PUBLICATIONS

International Search Report (ISR) dated Apr. 19, 2022 filed in PCT/JP2022/003841.

*Primary Examiner* — Omar F Hijaz
(74) *Attorney, Agent, or Firm* — RANKIN, HILL & CLARK LLP

(57) ABSTRACT

An anchor is provided whose number of processes of work at the time of performance of installation work can be reduced and which can selectively fix a plurality of types of fixing targets. An anchor 10 includes: a shaft 22 to be buried in a ground; a head 24 into which a propulsive force for propelling the shaft 22 in the ground is inputted, the head 24 being provided on an upper end portion 22*a* of the shaft 22; and a sleeve 26 having a tubular peripheral wall portion 42 placed around the head 24. An outer diameter of the head 24 is specified to be greater than an outer diameter of the shaft 22. Consequently, an undersurface 32*a* is secured on an outer peripheral portion 32 of the head 24. The peripheral wall portion 42 is provided in an upper end portion 42*a* with an opening portion 44 in which a first fixing target 12*c*, 12*d*, or 12*f* is fitted as needed. The peripheral wall portion 42 is provided in a lower end portion 42*b* with a retainer 46 including an opposing surface 48 facing the outer peripheral portion 32 (the undersurface 32*a*) of the head 24 from below,
(Continued)

and a retaining surface 50 to be pressed against a second fixing target 12*a* or 12*b* from above as needed.

13 Claims, 22 Drawing Sheets

(58) Field of Classification Search
CPC ... E02D 5/801; E02D 2200/1671; E02D 5/74; E02D 5/805; E02D 5/54; E04H 12/2223; E04H 12/2269; E04H 12/2215
See application file for complete search history.

(56) References Cited

U.S. PATENT DOCUMENTS 5,358,209 A * 10/1994 Ward ..... E04H 12/2223 248/533
6,298,611 B1 * 10/2001 Oliver ..... E02D 5/801 52/157
9,464,397 B1 * 10/2016 Abraham ..... E02D 5/801
10,352,014 B1 * 7/2019 Baptiste ..... A01K 1/04
2004/0103599 A1 * 6/2004 Keck ..... E02D 5/801 52/158
2006/0051183 A1 * 3/2006 Powell ..... E04H 12/2223 411/386
2007/0162023 A1 * 7/2007 Schock ..... A61B 17/7035 606/264
2011/0036025 A1 * 2/2011 Boulay ..... E02D 5/801 52/165
2011/0131895 A1 * 6/2011 Dempsey ..... A63B 63/004 52/157
2013/0115013 A1 * 5/2013 He ..... E02D 5/74 405/259.3
2014/0227041 A1 * 8/2014 Stroyer ..... E02D 5/80 405/252.1
2015/0114053 A1 * 4/2015 Staller ..... E04H 12/2223 52/165
2022/0098815 A1 * 3/2022 Zhou ..... E04B 1/34347

FOREIGN PATENT DOCUMENTS

JP 2013136913 A 7/2013
JP 2017014808 A 1/2017

* cited by examiner (A)

(B)

ANCHOR

TECHNICAL FIELD

The present invention relates to an anchor that fixes a fixing target on a ground surface.

BACKGROUND ART

The following Patent Literatures 1 and 2 disclose examples of known anchors. The anchor of Patent Literature 1 fixes a bearing plate constructed on the ground to the ground. The anchor includes a rod-like anchor body to be buried in the ground, an anchorage member, and a nut. When the bearing plate is fixed, a hole provided in the ground is filled with a grout material first. In addition, the anchor body is inserted. In this manner, the anchor body is fixed by use of the grout material. At this point in time, a space is secured in the upper part of the hole. Next, the anchorage member is placed in the space in the upper part of the hole. The nut is then threadedly engaged with a male thread provided on the upper end portion of the anchor body. Consequently, a pressing force that is applied from the nut presses the anchorage member against the bearing plate from above.

On the other hand, the anchor of Patent Literature 2 fixes a concrete support constructed on a slope to the slope. The anchor includes a rod-like anchor body to be buried in the slope, an anchor mounting washer, and a spherical nut body. When the concrete support is fixed, an anchor mounting hole provided in the slope is filled with a grout material first. In addition, the anchor body is inserted. In this manner, the anchor body is fixed by use of the grout material. Next, the anchor mounting washer is placed on the surface of the concrete support. The spherical nut body is then threadedly engaged with a male thread provided on the upper end portion of the anchor body. Consequently, a pressing force that is applied from the spherical nut body presses the anchor mounting washer against the concrete support from above.

CITATION LIST

Patent Literature

PATENT LITERATURE 1: JP-A-2000-178969
PATENT LITERATURE 2: JP-A-2012-246703

In terms of the anchors described in Patent Literatures 1 and 2, at the time of performance of installation work, it is necessary to provide in advance the hole for inserting the anchor body and the anchor mounting hole in the ground and the slope, respectively. Hence, there are many processes of work. Hence, there is a problem that the installation time is long and the installation cost is high. Moreover, these anchors have a configuration specialized in applications for fixing the bearing plate and the concrete support. Hence, it is difficult to fix other types of fixing targets by use of the same anchor.

SUMMARY OF INVENTION

The present invention handles the above problem. In other words, an object of the present invention is to provide an anchor whose number of processes of work at the time of performance of installation work can be reduced and which can selectively fix a plurality of types of fixing targets.

To achieve the above objective, an anchor according to the present invention that fixes a fixing target on a ground surface includes: a rod-like shaft to be buried in a ground; a head into which a propulsive force for propelling the shaft in the ground is inputted, the head being provided, coaxially with the shaft, on an upper end portion of the shaft; and a sleeve including a tubular peripheral wall portion placed around the head, in which: in plan view, a diameter of a first circumcircle circumscribing the head is specified to be greater than a diameter of a second circumcircle circumscribing the shaft; the peripheral wall portion is provided in an upper end portion thereof with an opening portion into which a first fixing target is fitted as needed; and the peripheral wall portion is provided in a lower end portion thereof with a retainer including an opposing surface facing an outer peripheral portion of the head from below, and a retaining surface to be pressed against a second fixing target from above as needed.

In this configuration, the head is provided on the upper end portion of the shaft of the anchor. The propulsive force for propelling the shaft in the ground is inputted into the head. Hence, at the time of performance of installation work, there is no need to form in advance a hole for inserting the shaft, in the ground. Therefore, the number of processes of work for the anchor at the time of performance of installation work can be reduced. As a result, the installation time can be reduced, and also the installation cost can be reduced.

Moreover, the first fixing target can be fitted into the opening portion of the peripheral wall portion of the anchor. Consequently, the first fixing target can be fixed on the ground surface. Moreover, the retainer of the peripheral wall portion of the anchor can retain the second fixing target from above. Consequently, the second fixing target can be fixed on the ground surface. In other words, in terms of the anchor according to the present invention, a plurality of types of fixing targets can be selectively fixed by use of a single anchor. Moreover, the opposing surface of the retainer of the anchor is placed in such a manner as to face the outer peripheral portion of the head from below. Hence, it is possible to prevent the entire sleeve from moving upward relative to the shaft buried in the ground. As a result, it is possible to prevent the second fixing target from slipping upward relative to the shaft and the head.

Moreover, the peripheral wall portion of the sleeve is placed around the head of the anchor. Hence, when the head and the sleeve are buried in the ground, the peripheral wall portion can prevent soil from entering around the head. Therefore, in terms of the anchor according to the present invention, it is easy to cause a force of a tool (such as an impact wrench or hammer) to act on the head buried in the ground. Moreover, the sleeve can receive an external force that acts on the anchor, near the ground surface. Hence, it is possible to prevent the external force from acting directly on the head. As a result, it is possible to prevent damage to or distortion of the head.

Another feature of the anchor according to the present invention is that the retaining surface is formed in a tapered shape having an outer diameter that becomes progressively less toward a downward direction.

In this configuration, the retainer of the anchor according to the present invention is formed in a shape that tapers downward. Hence, it is easy to bury the sleeve in the ground.

Still another feature of the anchor according to the present invention is that the head includes a bottomed hole that is open upward and coaxial with the shaft, and the bottomed hole includes, on an inner peripheral surface thereof, a first female thread to be threadedly engaged with a first male thread for joining a third fixing target to the head, as needed.

In terms of the anchor according to the present invention, which has this configuration, the male thread is threadedly engaged with the female thread and therefore the third fixing target can be fixed on the ground surface.

Still another feature of the anchor according to the present invention is that the sleeve is configured to be movable in an axial direction relative to the shaft.

In this configuration, the sleeve of the anchor according to the present invention can be moved downward relative to the head. Consequently, it is possible to cause the head to slip out of the inner space of the sleeve. Hence, when the shaft is propelled in the ground, it is easy to cause the force of a tool (such as an impact wrench or hammer) to act on the head.

Still another feature of the anchor according to the present invention is that the shaft is provided with a helical digging blade.

In this configuration, the rotational force (propulsive force) that is inputted from the head of the anchor according to the present invention allows the head, the shaft, and the digging blade to rotate. Consequently, the head, the shaft, and the digging blade can be propelled in their entirety in the axial direction in the ground.

Still another feature of the anchor according to the present invention is that the head is provided with a tool mounting portion on which a rotary tool for rotating the shaft is mounted in the axial direction.

In the anchor according to the present invention, which has this configuration, a rotary tool (such as an impact wrench) is mounted in the tool mounting portion provided to the head in the axial direction, which, combined with providing the head on the upper end portion of the shaft, makes it easy to mount the rotary tool.

Still another feature of the anchor according to the present invention is that a ring-shaped groove extending in a circumferential direction on an entire circumference thereof.

In this configuration, the ring-shaped groove of the anchor according to the present invention can be placed above the ground surface. Consequently, for example, a rope that is stretched along the ground surface can be looped around the groove.

Still another feature of the anchor according to the present invention is that the peripheral wall portion is provided on the outer peripheral surface thereof with a mating surface to which a fourth fixing target is mated as needed.

In terms of the anchor according to the present invention, which has this configuration, the fourth fixing target can be mated to the mating surface. Consequently, the fourth fixing target can be fixed on the ground surface.

Still another feature of the anchor according to the present invention is that the peripheral wall portion includes, on an inner peripheral surface thereof, a second female thread to be threadedly engaged with a second male thread for joining a fifth fixing target to the sleeve, as needed.

In terms of the anchor according to the present invention, which has this configuration, the second male thread is threadedly engaged with the second female thread and therefore the fifth fixing target can be fixed on the ground surface.

Still another feature of the anchor according to the present invention is that the peripheral wall portion includes, on the outer peripheral surface thereof, a third male thread to be threadedly engaged with a third female thread for joining a sixth fixing target to the sleeve, as needed.

In terms of the anchor according to the present invention, which has this configuration, the third male thread is threadedly engaged with the third female thread and therefore the sixth fixing target can be fixed on the ground surface.

Still another feature of the anchor according to the present invention is that the anchor includes a first nut including the third female thread threadedly engaged with the third male thread, the sixth fixing target includes a plate-shaped foundation plate having a through-hole, and the peripheral wall portion is inserted through the through-hole and the first nut is pressed against a top surface of the foundation plate.

In this configuration, the first nut of the anchor according to the present invention can retain the foundation plate. Consequently, the sixth fixing target can be fixed on the ground surface Still another feature of the anchor according to the present invention is that the anchor includes a second nut including the third female thread threadedly engaged with the third male thread, and the foundation plate is placed on a top surface of the second nut.

In this configuration, the second nut of the anchor according to the present invention can receive the foundation plate. Hence, the sixth fixing target can be fixed, spaced away from the ground surface. Moreover, the anchor according to the present invention can reliably fix the foundation plate, sandwiching the foundation plate between the first nut and the second nut.

BRIEF DESCRIPTION OF DRAWINGS

FIG. 1(*a*) is a plan view; and FIG. 1(*b*) is a front view (partial cross-sectional view);

FIG. 3(*a*) is a plan view; and FIG. 3(*b*) is a front view (partial cross-sectional view);

FIG. 13(*a*) is a plan view; and FIG. 13(*b*) is a front view (partial cross-sectional view);

FIG. 14(*a*) is a front view (partial cross-sectional view); and FIG. 14(*b*) is an exploded front view (partial cross-sectional view);

FIG. 15(*a*) is a front view (partial cross-sectional view); and FIG. 15(*b*) is an exploded front view (partial cross-sectional view):

FIG. 16(*a*) is a plan view; and FIG. 16(*b*) is a front view (partial cross-sectional view);

FIG. 17(*a*) is a plan view; FIG. 17(*b*) is a front view (partial cross-sectional view); and FIG. 17(*c*) is an exploded front view (partial cross-sectional view);

FIG. 18(*a*) is a plan view; and FIG. 18(*b*) is a front view (partial cross-sectional view);

FIG. 19(*a*) is a plan view; and FIG. 19(*b*) is a front view (partial cross-sectional view);

FIG. 20(*b*) is a front view (partial cross-sectional view) illustrating a third usage state of the anchor according to the fifth embodiment:

FIG. 22(*a*) is a plan view; and FIG. 22(*b*) is a front view (partial cross-sectional view).

DESCRIPTION OF EMBODIMENTS

Embodiments of an anchor according to the present invention are described hereinafter with reference to the drawings.

(Configuration of Anchor According to First Embodiment)

Figure 1:
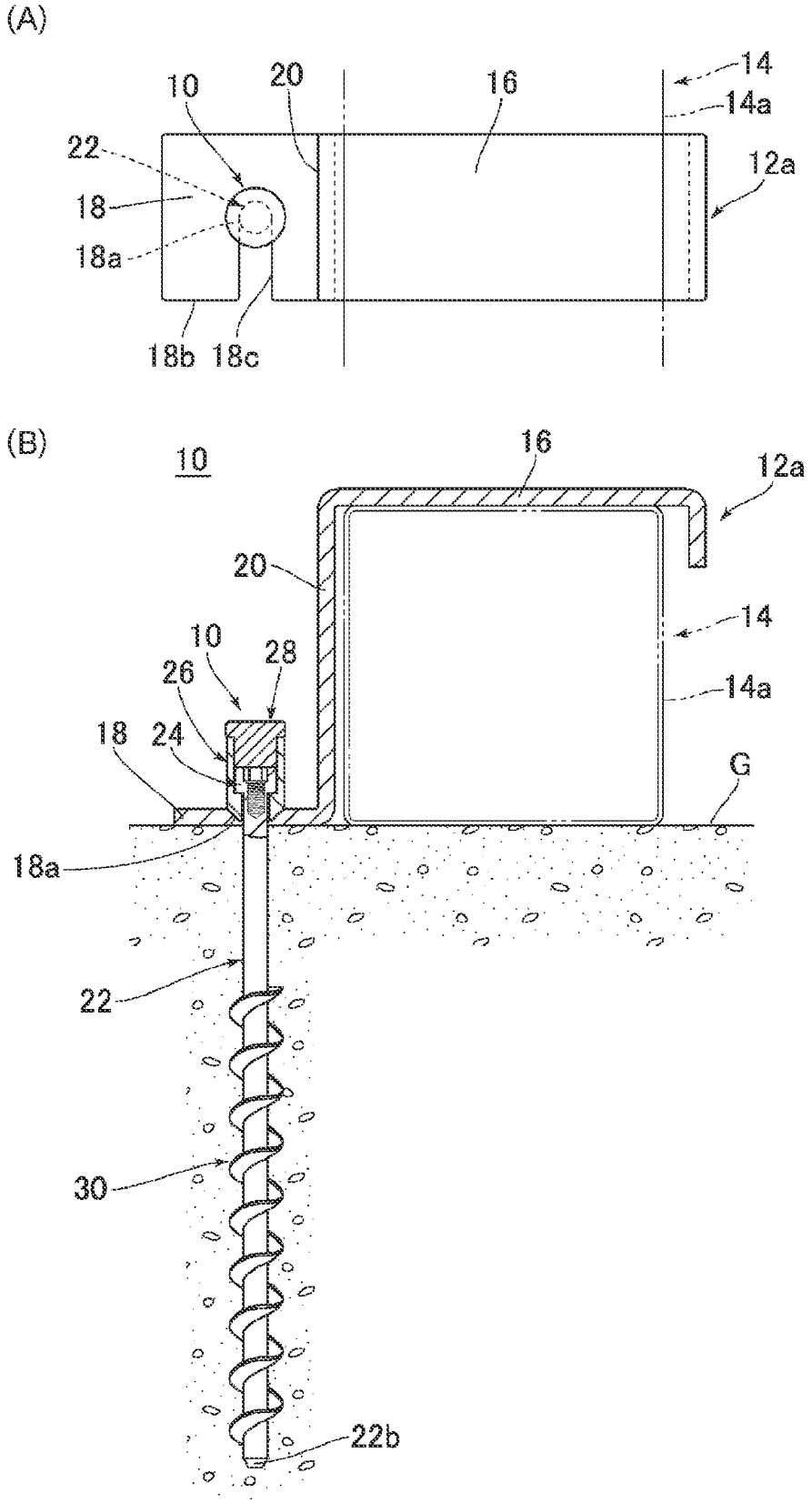
FIG. 1 is diagrams illustrating a first usage state of an anchor according to a first embodiment of the present invention.
Figure 2:
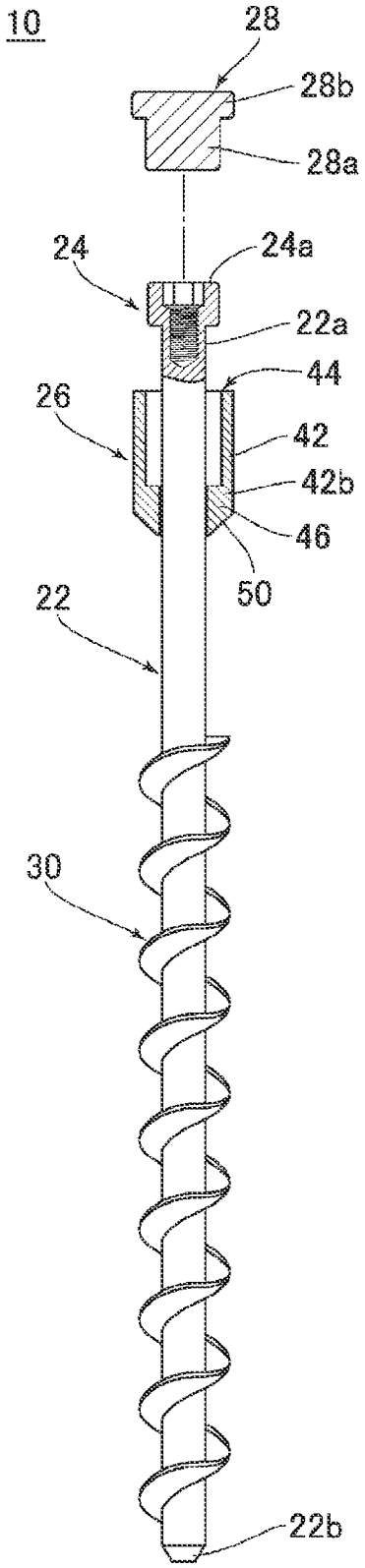
FIG. 2 is a front view (partial cross-sectional view) illustrating the configuration of the anchor according to the first embodiment.
Figure 3:
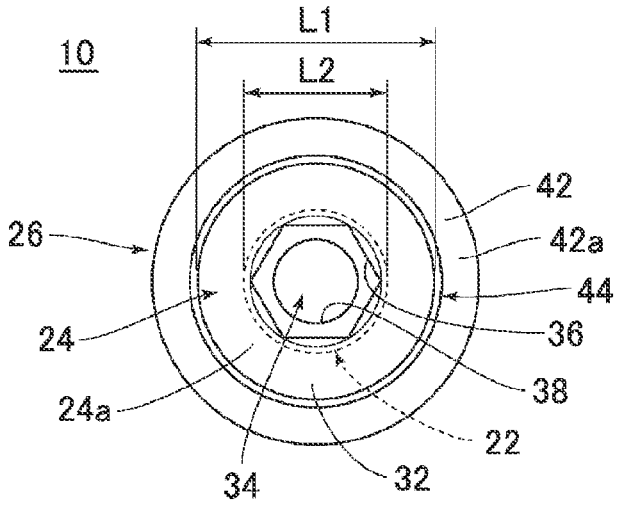
FIG. 3 is diagrams illustrating the configuration of main elements of the anchor according to the first embodiment.
Figure 3:
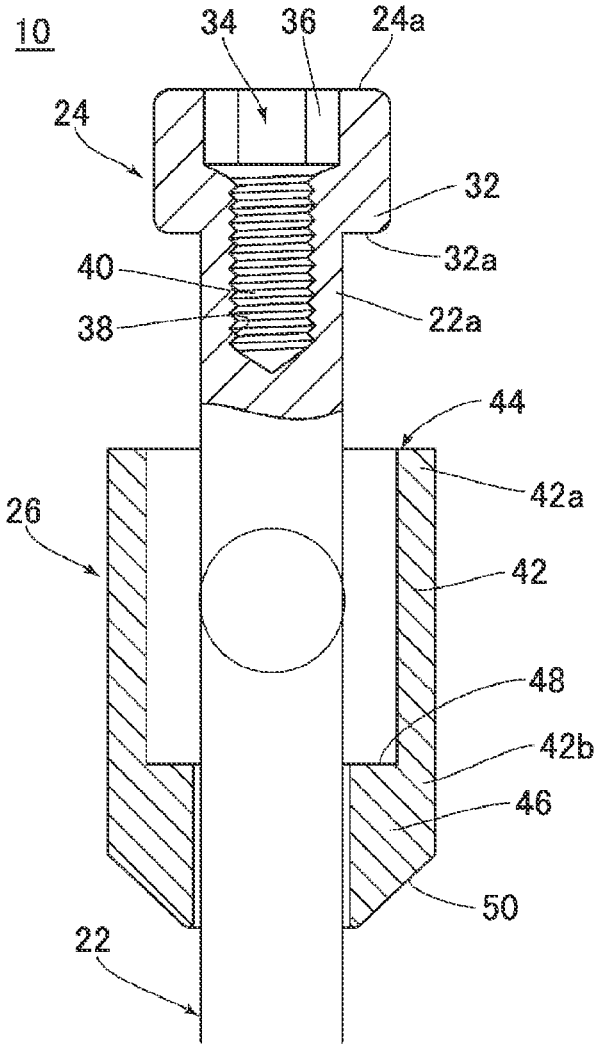

FIG. 1 is diagrams illustrating a first usage state of an anchor 10 according to a first embodiment of the present invention. FIG. 1(*a*) is a plan view. FIG. 1(*b*) is a front view (partial cross-sectional view). FIG. 2 is a front view (partial cross-sectional view) illustrating the configuration of the anchor 10. FIG. 3 is diagrams illustrating the configuration of main elements of the anchor 10. FIG. 3(*a*) is a plan view. FIG. 3(*b*) is a front view (partial cross-sectional view). FIGS. 4 to 8 are front views (partial cross-sectional views) illustrating other usage states of the anchor 10.

The anchor 10 illustrated in FIG. 2 selectively fixes fixing targets 12*a* to 12*f* (FIGS. 1 and FIGS. 4 to 8) on a ground surface G. The fixing targets 12*a* to 12*f* are of various types. The anchor 10 is configured in such a manner as to be capable of selectively adopting three fixing methods according to the types of the fixing targets 12*a* to 12*f*. In other words, the anchor 10 is configured in such a manner as to be capable of selectively adopting any of a "retaining method," a "fitting method," and a "first threaded engagement method."

In the following description, the fixing targets 12*a* to 12*f* are distinguished based on the fixing methods of the anchor 10. For this purpose, the fixing targets 12*c*, 12*d*, and 12*f* that adopt the "fitting method" are referred to as the "first fixing targets 12*c*, 12*d*, and 12*f*." Moreover, the fixing targets 12*a* and 12*b* that adopt the "retaining method" are referred to as the "second fixing targets 12*a* and 12*b*." Furthermore, the fixing target 12*e* that adopts the "first threaded engagement method" is referred to as the "third fixing target 12*e*."

The second fixing target 12*a* illustrated in FIGS. 1(*a*) and 1(*b*) is "fastening hardware" for fixing a soccer goal 14. As illustrated in FIG. 1(*b*), the soccer goal 14 includes a lower frame 14*a* having a quadrilateral cross-section. The lower frame 14*a* is placed on the ground surface G. The second fixing target 12*a* includes a plate-shaped retainer 16 that retains the lower frame 14*a* from above, a plate-shaped base portion 18 that is placed on the ground surface G, and a plate-shaped connecting portion 20 that connects the retainer 16 and the base portion 18.

As illustrated in FIG. 1(*a*), a through-hole 18*a* is formed in the center of the base portion 18. A shaft 22 (FIG. 2) of the anchor 10 described below is passed through the through-hole 18*a* in the up-and-down direction. A slit 18*c* is formed between the through-hole 18*a* and a side edge 18*b* of the base portion 18. The through-hole 18*a* is open toward a space on the side of the base portion 18 through the slit 18*c*. As illustrated in FIG. 1(*b*), an inner peripheral surface of the through-hole 18*a* is formed in a tapered shape having an inner diameter that becomes progressively less toward a downward direction.

As illustrated in FIG. 2, the anchor 10 includes a shaft 22 that is buried in the ground, a head 24 that is provided on an upper end portion 22*a* of the shaft 22 in such a manner as to be coaxial with the shaft 22, a sleeve 26 that is placed around the head 24 during use, and a cap 28.

The shaft 22 is a rod-like member that is buried in the ground from the ground surface G (FIG. 1(*b*)). The shaft 22 of the embodiment is a round bar having a circular cross-section. An outer peripheral surface of a lower end portion 22*b* of the shaft 22 is formed in a tapered shape having an outer diameter that becomes progressively less toward the downward direction. An outer peripheral surface of a portion of the shaft 22 between the lower end and slightly above the middle in the up-and-down direction is provided with a helical digging blade 30.

The diameter and length of the shaft 22 are not particularly limited. In the embodiment, the diameter is specified as 8 mm, and the length as 250 mm. Moreover, the maximum outer diameter and axial length of the digging blade 30 are not particularly limited. In the embodiment, the maximum outer diameter is specified as 17 mm, and the axial length as 150 mm. Moreover, a method for forming the digging blade 30 is not particularly limited. In the embodiment, a method that welds the digging blade 30 to the shaft 22 inserted through the sleeve 26 is adopted.

As illustrated in FIGS. 3(*a*) and 3(*b*), the head 24 is a portion into which a propulsive force for propelling the shaft 22 in the ground is inputted. The head 24 is formed in a columnar shape in such a manner as to be coaxial with the shaft 22. In plan view, a diameter L1 of a first circumcircle that circumscribes the head 24 is specified to be greater than a diameter L2 of a second circumcircle that circumscribes the shaft 22. Consequently, a flat undersurface 32*a* (FIG. 3(*b*)) that faces downward is secured on an outer peripheral portion 32 of the head 24. Note that in the embodiment, the head 24 is formed in a circular shape in plan view. Hence, the first circumcircle agrees with a visible outline of the head 24 in plan view. The diameter L1 of the first circumcircle agrees with an outer diameter of the head 24. Moreover, the shaft 22 is formed in a circular shape in plan view. Hence, the second circumcircle agrees with a visible outline of the shaft 22 in plan view. The diameter L2 of the second circumcircle agrees with an outer diameter of the shaft 22.

In the embodiment, the digging blade 30 (FIG. 2) is rotated to propel the shaft 22 in the ground. Hence, the propulsive force is inputted into the head 24 as a rotational force that rotates the digging blade 30. Hence, the head 24 is provided with a tool mounting portion 34. A rotary tool (such as an impact wrench) for rotating the shaft 22, the head 24, and the digging blade 30 in their entirety is mounted in the tool mounting portion 34 in the axial direction. The tool mounting portion 34 of the embodiment includes a first bottomed hole 36 that is hexagonal in plan view and formed in the center of the head 24. When the rotational force is inputted into the head 24, a hexagonal wrench (illustration omitted) being a rotary tool is inserted into the first bottomed hole 36 in the axial direction.

Figure 7:
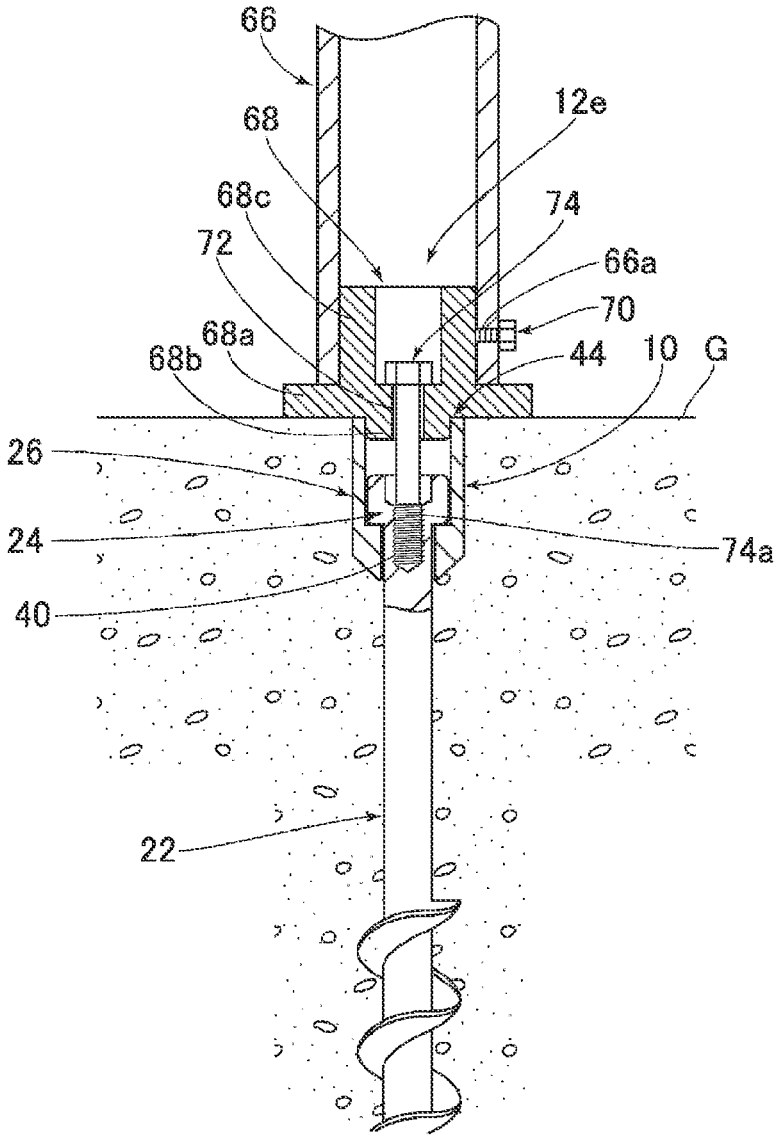
FIG. 7 is a front view (partial cross-sectional view) illustrating a fifth usage state of the anchor according to the first embodiment.

As illustrated in FIG. 3(*b*), a second bottomed hole 38 that is circular in plan view and open upward is formed in a portion, which is located below the first bottomed hole 36, of each of the shaft 22 and the head 24 in such a manner as to be coaxial with the shaft 22. A female thread (first female thread) 40 is formed on an inner peripheral surface of the second bottomed hole 38. As illustrated in FIG. 7, the female thread 40 (first female thread) is threadedly engaged with a male thread (first male thread) 74*a* of a male threaded member 74 for joining the third fixing target 12*e* to the head 24 as needed.

As illustrated in FIGS. 3(*a*) and 3(*b*), the sleeve 26 includes a tubular peripheral wall portion 42 that is placed around the head 24 during use. An upper end portion 42*a* of the peripheral wall portion 42 is provided with an opening portion 44. The first fixing target 12*c*, 12*d*, or 12*f* (FIG. 5, 6, or 8), which is described below, is fitted into the opening portion 44 as needed. A lower end portion 42*b* of the peripheral wall portion 42 is provided with a retainer 46 (FIG. 3(*b*)). The retainer 46 retains the second fixing target 12*a* or 12*b* (FIG. 1 or 4) as needed. An inner and an outer diameter of a portion, which excludes the lower end portion 42*b*, of the peripheral wall portion 42 are specified to be constant along an entire length thereof in the axial direction.

The retainer 46 includes an annular opposing surface 48 that faces the outer peripheral portion 32 (the undersurface 32*a*) of the head 24 from below, and an annular retaining surface 50 that is pressed against the second fixing target 12*a* or 12*b* (FIG. 1 or 4) from above as needed. The retaining surface 50 is formed in a tapered shape having an outer diameter that becomes progressively less toward the downward direction. Consequently, the retainer 46 is formed in a shape that tapers downward. The taper angle of the retaining surface 50 is specified to be equal to the taper angle of the inner peripheral surface of the through-hole 18*a* illustrated in FIG. 1(*b*). Therefore, when the retaining surface 50 retains the second fixing target 12*a*, the retaining surface 50 can be brought into surface contact with the inner peripheral surface of the through-hole 18*a*.

The inner diameter of the retainer 46 has a size that is less than the outer diameter of the head 24 and is greater than the outer diameter of the shaft 22. The inner diameter of the retainer 46 is specified to be constant along an entire length thereof in the axial direction. Consequently, clearance is secured between an inner peripheral surface of the retainer 46 and the outer peripheral surface of the shaft 22. Hence, the sleeve 26 can move in the axial direction relative to the shaft 22.

Note that the material of the shaft 22, the head 24, the sleeve 26, and the digging blade 30 is not particularly limited. In the embodiment, a metal such as stainless, aluminum, or iron is used.

The cap 28 illustrated in FIG. 2 is a member that is mounted in the opening portion 44 to prevent dust or rain water from being accumulated in the sleeve 26. The cap 28 is made of a synthetic resin such as urethane. The cap 28 includes a columnar fitting portion 28*a* that is fitted in the opening portion 44, and a columnar head 28*b* that is formed with an increased diameter on the top of the fitting portion 28*a*. An outer diameter of the fitting portion 28*a* is specified to be substantially equal to an inner diameter of the opening portion 44 along an entire direction of the fitting portion 28*a* in the axial direction. Note that the cap 28 may be colored and used as a ground marker. In this case, the cap 28 is the "first fixing target" that is fixed by the "fitting method" on the ground surface G.

(Anchor Installation Method According to First Embodiment)

When the second fixing target 12*a* illustrated in FIGS. 1(*a*) and 1(*b*) is fixed by use of the anchor 10 illustrated in FIG. 2, a worker executes a "positioning step" of determining the position of the second fixing target 12*a* on the ground surface G, a "burying step" of burying the shaft 22 of the anchor 10 in the ground, and a "retaining step" of retaining the second fixing target 12*a* with the sleeve 26, in this order.

In the "positioning step," firstly, the second fixing target 12*a* is positioned relative to the lower frame 14*a* of the soccer goal 14 placed on the ground surface G. Consequently, the position of the through-hole 18*a* relative to the ground surface G is checked, and then the second fixing target 12*a* is temporarily removed from the lower frame 14*a*.

In the "burying step," firstly, the lower end portion 22*b* of the shaft 22 is placed at the position of the through-hole 18*a* on the ground surface G. A top surface 24*a* of the head 24 is then driven with, for example, a hammer to bury the lower end portion 22*b* of the shaft 22 in the ground. Next, a rotary tool (such as an impact wrench) is mounted in the tool mounting portion 34 of the head 24. A rotational force in the circumferential direction (forward direction) is inputted into the head 24 from the rotary tool. The head 24, the shaft 22, and the digging blade 30 are then rotated in their entity in the forward direction. At this point in time, the propulsive action of the digging blade 30 allows the shaft 22 to be buried in the ground. When the retaining surface 50 of the sleeve 26 illustrated in FIG. 2 comes close to the ground surface G, input of the rotational force by the rotary tool is stopped.

In the "retaining step," firstly, the second fixing target 12*a* is positioned again relative to the lower frame 14*a* of the soccer goal 14. At this point in time, the shaft 22 is passed through the slit 18*c* (FIG. 1(*a*)) of the base portion 18. Consequently, the shaft 22 is placed in the through-hole 18*a*. Next, the rotational force is further inputted into the head 24 from the rotary tool, and then the shaft 22 and the digging blade 30 are further propelled. Consequently, the retaining surface 50 (FIG. 2) of the sleeve 26 is pressed against the inner peripheral surface of the through-hole 18*a*. Finally, the cap 28 is mounted in the opening portion 44 of the sleeve 26.

(Other Applications of Anchor According to First Embodiment)

Figure 4:
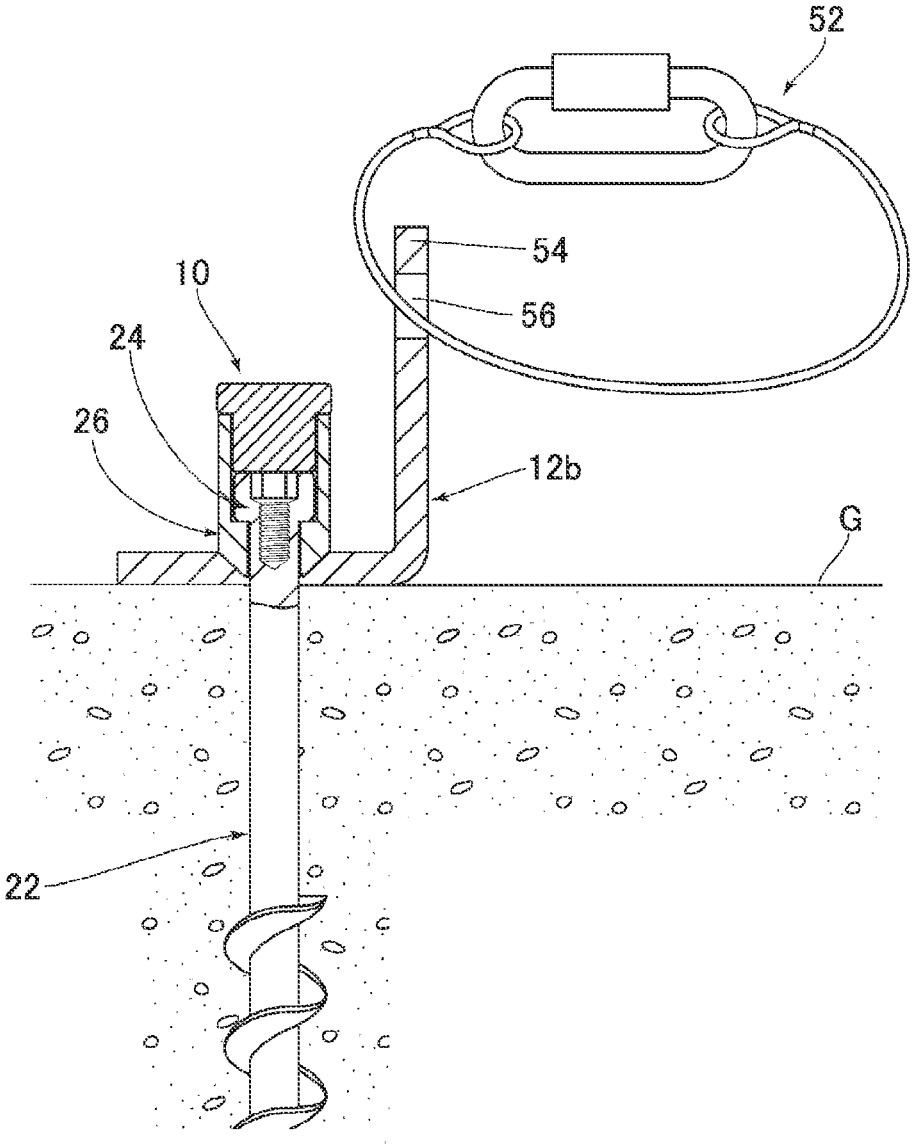
FIG. 4 is a front view (partial cross-sectional view) illustrating a second usage state of the anchor according to the first embodiment.
Figure 5:
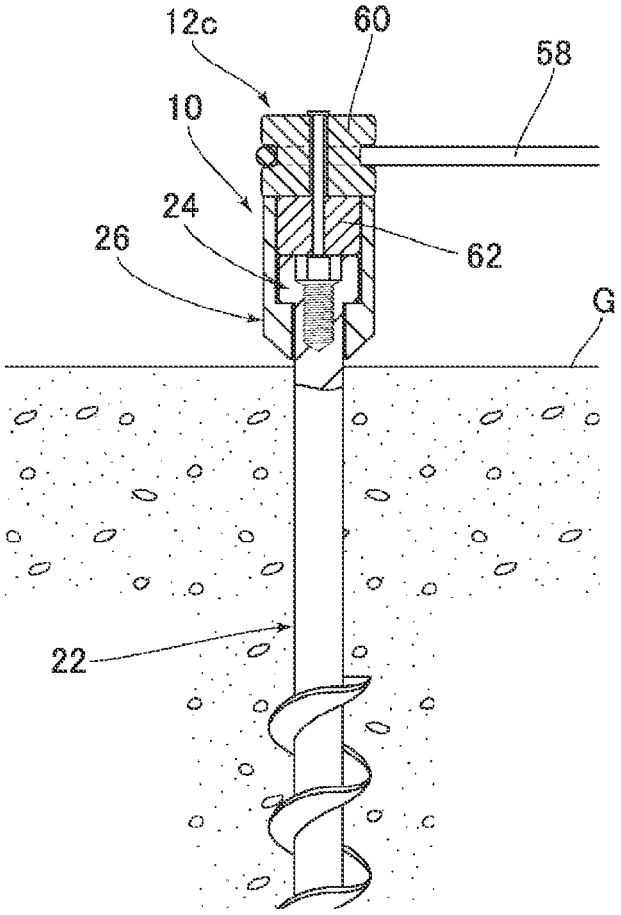
FIG. 5 is a front view (partial cross-sectional view) illustrating a third usage state of the anchor according to the first embodiment.
Figure 6:
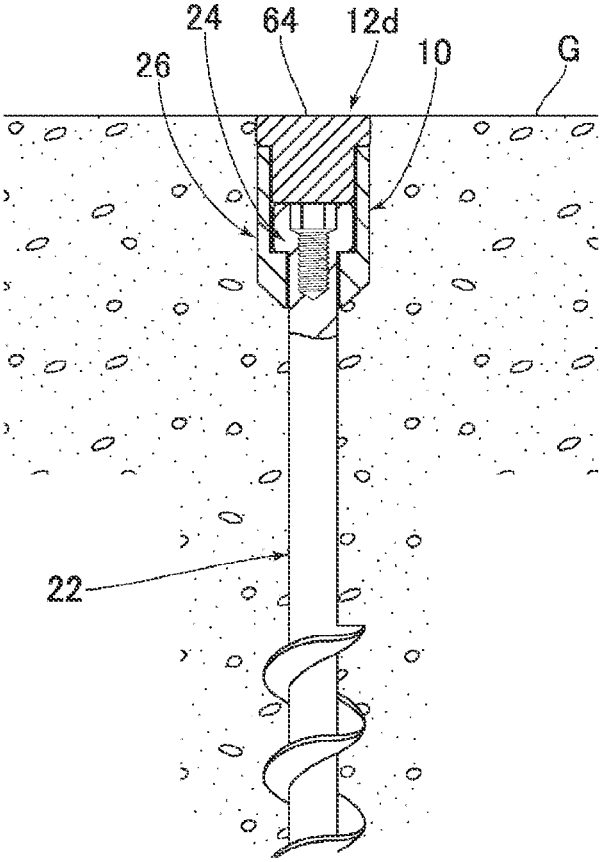
FIG. 6 is a front view (partial cross-sectional view) illustrating a fourth usage state of the anchor according to the first embodiment.
Figure 8:
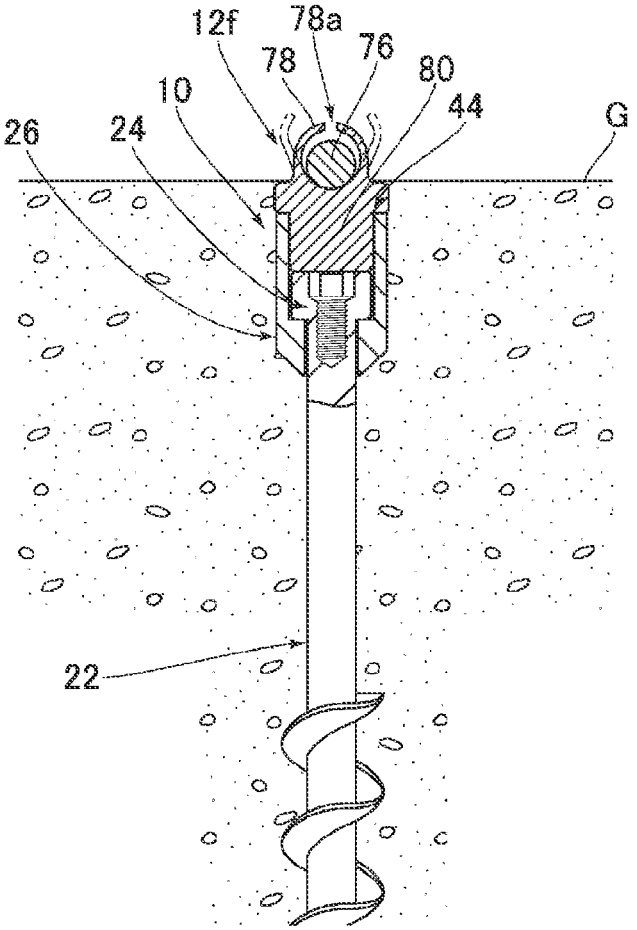
FIG. 8 is a front view (partial cross-sectional view) illustrating a sixth usage state of the anchor according to the first embodiment.

FIG. 4 is a front view (partial cross-sectional view) illustrating a second usage state of the anchor 10. FIG. 5 is a front view (partial cross-sectional view) illustrating a third usage state of the anchor 10. FIG. 6 is a front view (partial cross-sectional view) illustrating a fourth usage state of the anchor 10. FIG. 7 is a front view (partial cross-sectional view) illustrating a fifth usage state of the anchor 10. FIG. 8 is a front view (partial cross-sectional view) illustrating a sixth usage state of the anchor 10. The second fixing target 12*a* illustrated in FIGS. 1(*a*) and 1(*b*) is "fastening hardware" for fixing the soccer goal 14. However, the types of fixing target may be changed as appropriate. In other words, the anchor 10 may be used for other applications for fixing the other fixing targets 12*b* to 12*f* illustrated in FIGS. 4 to 8.

The second fixing target 12*b* illustrated in FIG. 4 is "fastening hardware" for fixing a ring-shaped wire member 52. The "retaining method" is adopted as the method for fixing the anchor 10. The retainer 16 is removed from the second fixing target 12*a* illustrated in FIGS. 1(*a*) and 1(*b*) in the configuration of the second fixing target 12*b*. Moreover, a through-hole 56 through which the wire member 52 is inserted is formed in a wall portion 54 corresponding to the connecting portion 20 of the second fixing target 12*a*.

The first fixing target 12*c* illustrated in FIG. 5 is a "pulley" over which a wire 58 is looped. The "fitting method" is adopted as the method for fixing the anchor 10. The first fixing target 12*c* includes a pulley body 60 and a support portion 62 that rotatably supports the pulley body 60. The support portion 62 is fitted in the opening portion 44 (FIG. 2) of the sleeve 26.

The first fixing target 12*d* illustrated in FIG. 6 is a "ground marker" configured similarly to the cap 28 illustrated in FIG. 2. The "fitting method" is adopted as the method for fixing the anchor 10. In the usage state illustrated in FIG. 6, atop surface 64 of the first fixing target 12*d* is placed at a height substantially equal to (flush with) the ground surface G. Hence, the head 24 and sleeve 26 of the anchor 10, together with the shaft 22, are buried in the ground. Note that the "ground marker" as the first fixing target 12*d* may include a light-emitting diode (LED).

The third fixing target 12*e* illustrated in FIG. 7 is a "corner post or freestanding pole stand." The "first threaded engagement method" is adopted as the method for fixing the anchor 10. The third fixing target 12*e* includes a support 68 that supports a cylindrical pole 66. The support 68 includes a plate-shaped substrate 68*a*, and a cylindrical first mating portion 68*b*. The first mating portion 68*b* is formed in such a manner as to protrude downward from an undersurface of the substrate 68*a*, and is fitted in the opening portion 44 of the sleeve 26. Moreover, the support 68 includes a cylindrical second mating portion 68*c*. The second mating portion 68*c* is formed in such a manner as to protrude upward from a top surface of the substrate 68*a*, and is fitted in the pole 66. A threaded hole 66*a* is formed in a peripheral wall of a lower end portion of the pole 66. A bolt 70 is threadedly engaged with the threaded hole 66*a*. A distal end portion of the bolt 70 is pressed against the second mating portion 68*c*. Consequently, the pole 66 is fixed to the support 68.

Moreover, a through-hole 72 is formed in the center of the substrate 68*a*. A "bolt" as the male threaded member 74 having the male thread 74*a* is inserted through the through-hole 72 from above. The male thread 74*a* is threadedly engaged with the female thread 40 of the anchor 10. Consequently, the third fixing target 12*e* is joined to the head 24.

The first fixing target 12*f* illustrated in FIG. 8 is a "rope catcher" that holds a rope 76. The "fitting method" is adopted as the method for fixing the anchor 10. The first fixing target 12*f* includes a (horizontally oriented) C-shaped rope holder 78 that is open upward, and a cylindrical mating portion 80 that is fitted into the opening portion 44. The rope holder 78 and the mating portion 80 are integrally formed with a synthetic resin. The width of an opening 78*a* of the rope holder 78 is specified to be less than the diameter of the rope 76. When the rope 76 is attached to and detached from the rope holder 78, the rope holder 78 is elastically deformed to increase the width of the opening 78.

(Effects of Anchor According to First Embodiment)

According to the embodiment, the following effects can be exerted by the above configurations. In other words, the upper end portion 22*a* of the shaft 22 illustrated in FIG. 3(*b*) is provided with the head 24. In addition, the propulsive force for propelling the shaft 22 in the ground is inputted into the head 24. Consequently, at the time of performance of installation work, there is no need to form in advance a hole for inserting the shaft 22 in the ground. Therefore, the number of processes of work at the time of performance of installation work can be reduced. Hence, the installation time can be reduced, and also the installation cost can be reduced.

The first fixing target 12*c*. 12*d*, or 12*f* (FIG. 5, 6, or 8) is fitted into the opening portion 44, which is illustrated in FIG. 3(*b*), of the peripheral wall portion 42. Consequently, the first fixing target 12*c*, 12*d*, or 12*f* can be fixed on the ground surface G. Moreover, the retainer 46 of the peripheral wall portion 42 retains the second fixing target 12*a* or 12*b* (FIG. 1 or 4) from above. Consequently, the second fixing target 12*a* or 12*b* can be fixed on the ground surface G. Furthermore, the male thread 74*a*, which is illustrated in FIG. 7, of the male threaded member 74 is threadedly engaged with the female thread 40. Consequently, the third fixing target 12*e* can be fixed on the ground surface G. In other words, the plurality of types of the fixing targets 12*a* to 12*f* can be selectively fixed by use of the single anchor 10.

The opposing surface 48, which is illustrated in FIG. 3(*b*), of the retainer 46 is placed, facing the outer peripheral portion 32 (the undersurface 32*a*) of the head 24 from below. Therefore, it is possible to prevent the entire sleeve 26 from moving upward relative to the shaft 22 buried in the ground, and to prevent the second fixing targets 12*a* and 12*b* from slipping upward relative to the shaft 22 and the head 24.

The peripheral wall portion 42 of the sleeve 26 is placed around the head 24 illustrated in FIG. 3(*b*). Hence, it is possible to prevent soil from entering around the head 24 when the head 24 and the sleeve 26 are buried in the ground. Therefore, it is easy to cause a force of a tool (such as an impact wrench or a hammer) to act on the head 24 buried in the ground. Moreover, the sleeve 26 can receive an external force acting on the anchor 10 near the ground surface G. Hence, it is possible to prevent the external force from acting directly on the head 24. As a result, it is possible to prevent damage to or deformation of the head 24.

The retaining surface 50 illustrated in FIG. 3(*b*) is formed in the tapered shape having the outer diameter that becomes progressively less toward the downward direction. The retainer 46 is formed in the shape that tapers downward. Hence, it is easy to bury the sleeve 26 in the ground.

The sleeve 26 illustrated in FIG. 3(*b*) is configured in such a manner as to be movable in the axial direction relative to the shaft 22. Hence, the sleeve 26 can be moved downward relative to the head 24. Consequently, it is possible to cause the head 24 from slipping out of the inner space of the sleeve 26. Therefore, it is easy to cause the force of a tool (such as an impact wrench or a hammer) to act on the head 24 when the shaft 22 is propelled in the ground.

The shaft 22 illustrated in FIG. 3(*b*) is provided with the helical digging blade 30. Hence, the rotational force (propulsive force) that is inputted from the head 24 rotates the head 24, the shaft 22, and the digging blade 30. Consequently, the head 24, the shaft 22, and the digging blade 30 can be propelled in their entirety in the axial direction in the ground.

The head 24 illustrated in FIG. 3(*b*) is provided with the tool mounting portion 34. A rotary tool (such as an impact wrench) for rotating the shaft 22 is mounted in the tool mounting portion 34 in the axial direction, which, combined with providing the head 24 on the upper end portion 22*a* of the shaft 22, makes it easy to mount the rotary tool.

(Modifications)

Note that upon carrying out the present invention, the present invention is not limited to the embodiment and various modifications can be made unless they depart from the object of the present invention. In the embodiment, for example, each of the shaft 22 and the head 24 is formed in a circular shape in plan view as illustrated in FIG. 3(*a*). However, the shapes of the shaft 22 and the head 24 in plan view are not limited to the circular shape. The shapes in plan view may be formed in a polygonal shape such as a hexagon, or an elliptic shape. Also in these cases, in plan view, the diameter of the first circumcircle that circumscribes the head 24 is specified to be greater than the diameter of the second circumcircle that circumscribes the shaft 22. Consequently, the undersurface 32*a* can be secured on the outer peripheral portion 32 of the head 24.

In the embodiment, the female thread 40 that is threadedly engaged with the male thread 74*a* (FIG. 7) of the male threaded member 74 is formed in the head 24 as illustrated in FIG. 3(*b*). However, the female thread 40 may be omitted. Also in this case, either the "retaining method" or the "fitting method" can be adopted as the method for fixing the anchor 10. Hence, the plurality of types of the fixing targets 12*a* to 12*d* and 12*f* can be selectively fixed.

In the embodiment, the helical digging blade 30 is provided on the outer peripheral surface of the shaft 22 as illustrated in FIG. 2. However, the digging blade 30 may be omitted. In this case, there is no need to rotate the digging blade 30. Hence, there is no need to use a rotary tool. The top surface 24*a* of the head 24 may be driven with, for example, a hammer to input the propulsive force for propelling the shaft 22 in the ground.

In the embodiment, the tool mounting portion 34 provided to the head 24 includes the first bottomed hole 36 into which a hexagonal wrench (illustration omitted) being a rotary tool is inserted, as illustrated in FIG. 3(*b*). However, the tool mounting portion 34 may include two surfaces (illustration omitted) parallel to each other, on which a rotary tool (such as a socket wrench) can be caught, instead of the first bottomed hole 36.

In the configuration of the embodiment, the sleeve 26 can move in the axial direction relative to the shaft 22 as illustrated in FIG. 3(*b*). However, the sleeve 26 may be fixed to the shaft 22. Also in this case, the peripheral wall portion 42 can prevent soil from entering around the head 24. In addition, the peripheral wall portion 42 can protect the head 24.

Second Embodiment

Figure 9:
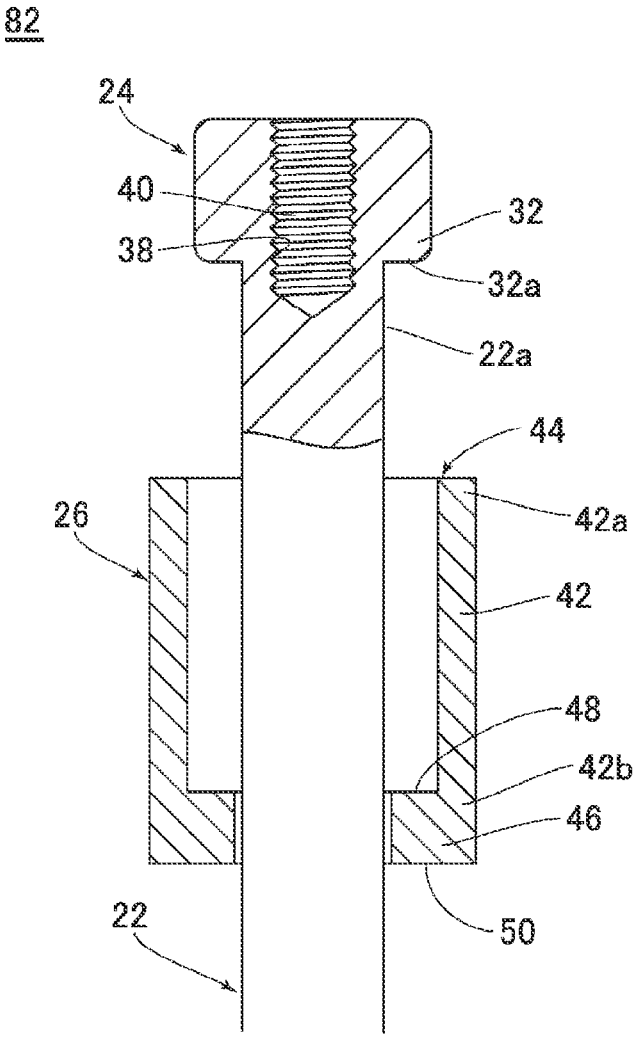
FIG. 9 is a front view (partial cross-sectional view) illustrating the configuration of an anchor according to a second embodiment of the present invention.

FIG. 9 is a front view (partial cross-sectional view) illustrating the configuration of an anchor 82 according to a second embodiment of the present invention. In the first embodiment, the retaining surface 50 of the retainer 46 is formed in the tapered shape having the outer diameter that becomes progressively less toward the downward direction. However, the retaining surface 50 may be formed in a flat surface perpendicular to a direction in which the shaft 22 extends, as in the anchor 82 according to the second embodiment illustrated in FIG. 9. Moreover, if the digging blade 30 is omitted, there is no need to rotate the digging blade 30. Hence, the first bottomed hole 36 (FIG. 3(*b*)) of the tool mounting portion 34 may be omitted.

Third Embodiment

Figure 10:
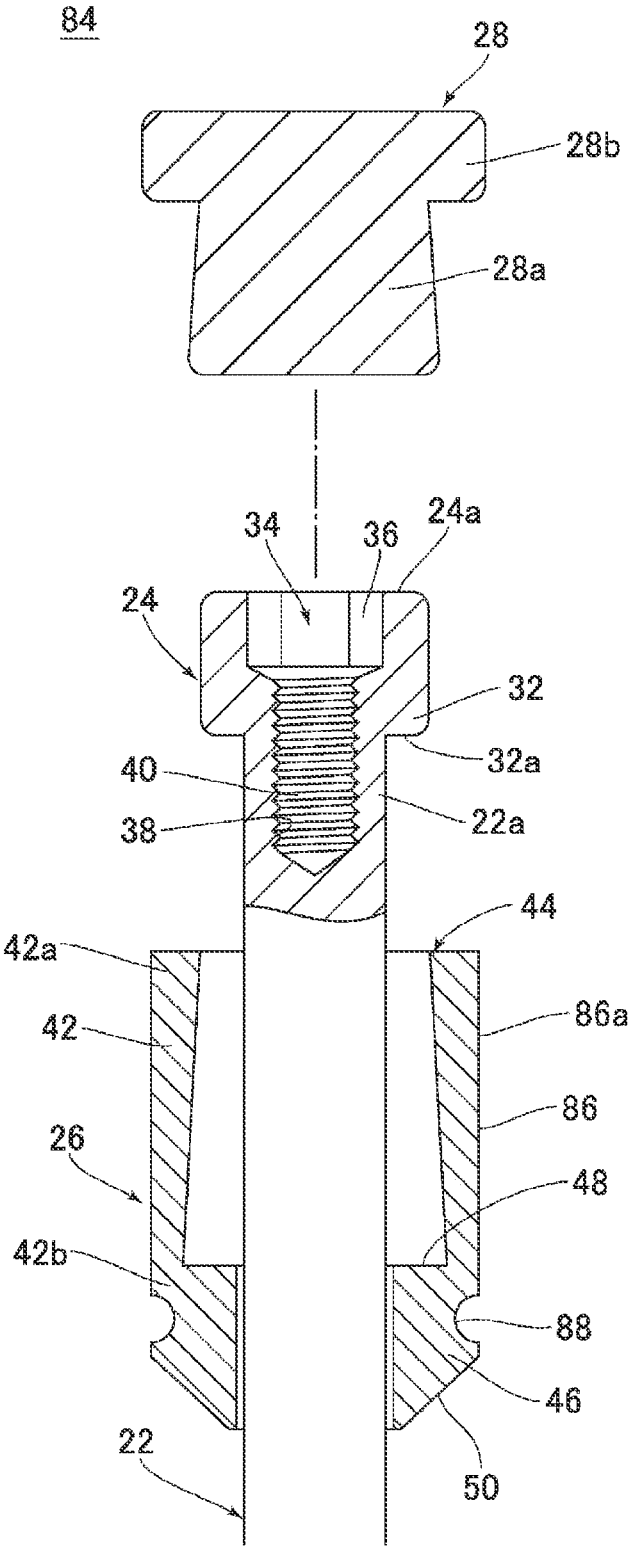
FIG. 10 is a front view (partial cross-sectional view) illustrating the configuration of main elements of an anchor according to a third embodiment of the present invention.
Figure 11:
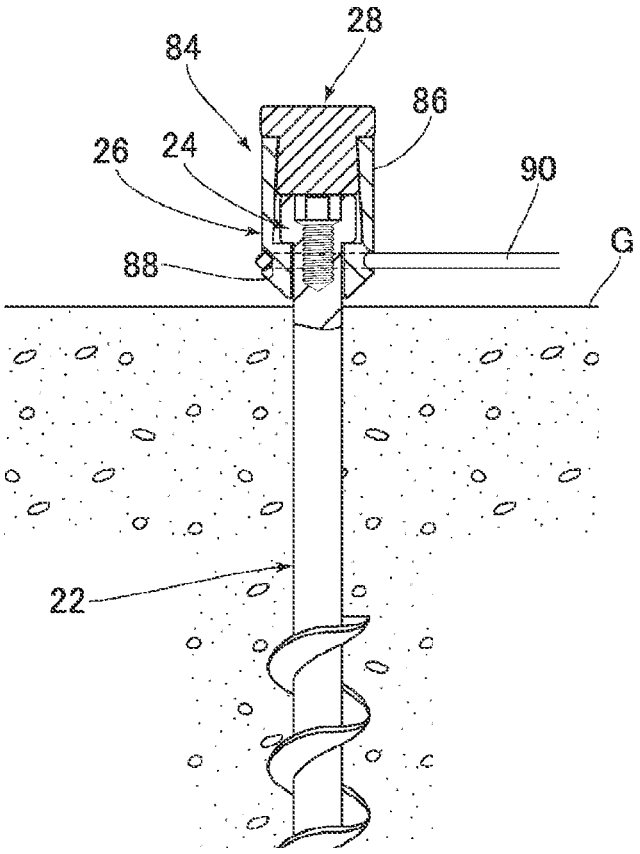
FIG. 11 is a front view (partial cross-sectional view) illustrating a first usage state of the anchor according to the third embodiment.
Figure 12:
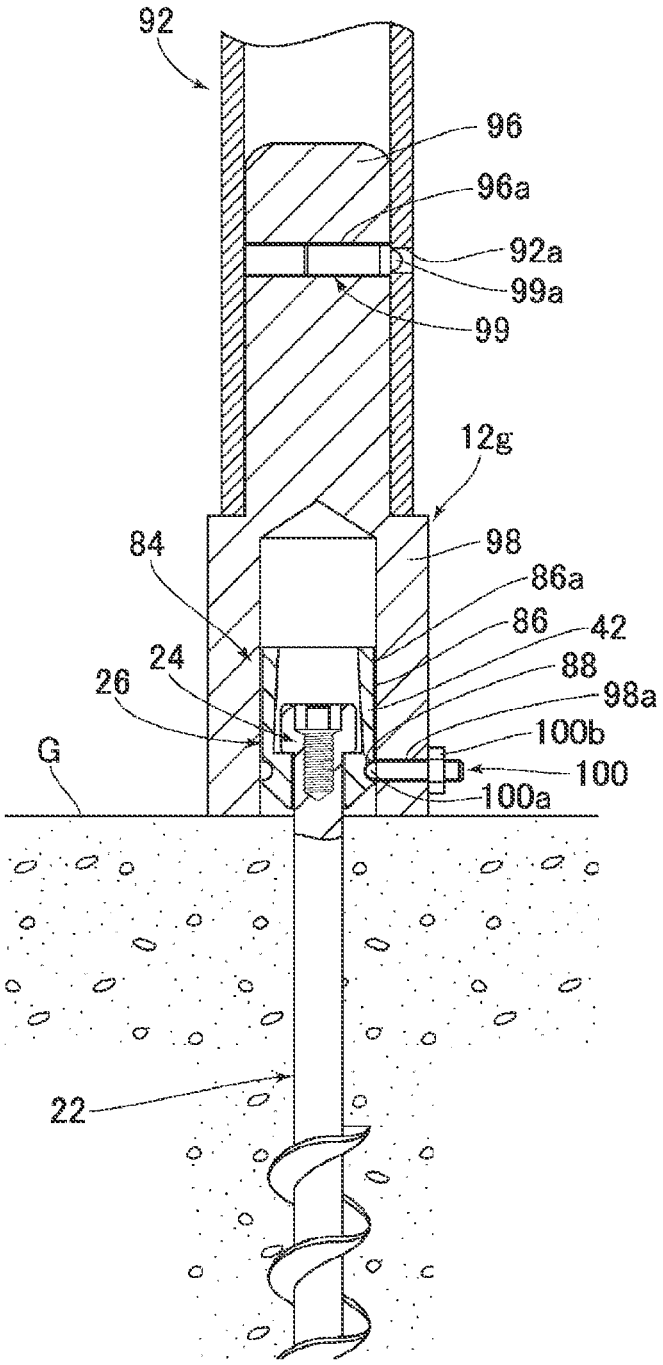
FIG. 12 is a front view (partial cross-sectional view) illustrating a second usage state of the anchor according to the third embodiment.

FIG. 10 is a front view (partial cross-sectional view) illustrating the configuration of an anchor 84 according to a third embodiment of the present invention. FIG. 11 is a front view (partial cross-sectional view) illustrating a first usage state of the anchor 84. FIG. 12 is a front view (partial cross-sectional view) illustrating a second usage state of the anchor 84.

In the first embodiment, each of an inner diameter of the portion, which excludes the lower end portion 42*b*, of the peripheral wall portion 42 of the sleeve 26, and the outer diameter of the fitting portion 28*a* of the cap 28 is specified to be constant along the entire length thereof in the axial direction. However, tapered shapes in which the inner diameter of the portion excluding the lower end portion 42*b* and the outer diameter of the fitting portion 28*a* become progressively greater toward the downward direction may be formed as in the anchor 84 according to the third embodiment illustrated in FIG. 10. Moreover, a groove 88 extending in the circumferential direction may be formed in a ring shape on the entire circumference of an outer peripheral surface 86 of the peripheral wall portion 42. Furthermore, the outer peripheral surface 86 of the peripheral wall portion 42 may be provided with a mating surface 86*a* as needed. In this case, a fourth fixing target 12*g* (FIG. 12) may be mated to the mating surface 86*a*.

In terms of the anchor 84 according to the third embodiment, the ring-shaped groove 88 is placed above the ground surface G as illustrated in FIG. 11. Consequently, for example, a rope 90 that is stretched along the ground surface G can be looped around the groove 88. Moreover, the fitting portion 28*a* of the cap 28 illustrated in FIG. 10 can be fitted into the opening portion 44 while being compressed. Hence, the sealability of the opening portion 44 can be increased. In addition, it is possible to prevent the cap 28 from dropping off.

In terms of the anchor 84 according to the third embodiment, the fourth fixing target 12*g* is mated to the mating surface 86*a* as illustrated in FIG. 12. Consequently, the fourth fixing target 12*g* can be fixed on the ground surface G. In other words, in addition to the above-mentioned "retaining method," "fitting method," and "first threaded engagement method," a "mating method" for fixing the fourth fixing target 12*g* can be adopted.

The fourth fixing target 12*g* illustrated in FIG. 12 is a "freestanding pole stand" that supports a pole 92. The fourth fixing target 12*g* includes a columnar insertion portion 96 that is detachably inserted into a lower end portion of the pole 92, and a cylindrical support portion 98 that is detachably mated to the mating surface 86*a* of the anchor 84.

A through-hole % a including a female thread is formed in the insertion portion 96, extending in the radial direction. A first plunger 99 including a male thread is screwed into the through-hole 96*a*. A through-hole 92*a* is formed in a portion, which faces the through-hole 96*a*, of the pole 92. When the insertion portion 96 is inserted into the lower end portion of the pole 92, a spherical (or rod-like) stopper member 99*a* provided to a distal end portion of the first plunger 99 is completely inserted against a bias force of a spring member provided in the first plunger 99. When the insertion of the insertion portion 96 is complete, the stopper member 99*a* is pushed out by the spring member and fitted into the through-hole 92*a*. Consequently, the pole 92 is prevented from slipping out of the insertion portion 96.

A through-hole 98*a* including a female thread is formed in a portion, which faces the groove 88 of the anchor 84, of a peripheral wall of the support portion 98, the through-hole 98*a* extending in the radial direction. A second plunger 100 including a male thread is screwed into the through-hole 98*a*. A back end portion of the second plunger 100 protrudes outward from an outer peripheral surface of the support portion 98. The back end portion is threadedly engaged with a nut 100*b*. The nut 100*b* is then pressed against the outer peripheral surface of the support portion 98. Consequently, the second plunger 100 is fixed to the support portion 98. When the support portion 98 is mated to the mating surface 86*a* of the anchor 84, a spherical (or rod-like) stopper member 100*a* provided to a distal end portion of the second plunger 100 is completely inserted against a bias force of a spring member provided in the second plunger 100. When the mating of the support portion 98 is complete, the stopper member 100*a* is pushed out by the spring member and fitted into the groove 88. Consequently, the support portion 98 is prevented from slipping out from the anchor 84.

Note that a first bolt and a second bolt (illustration omitted) may be used instead of the first plunger 99 and the second plunger 100, which are illustrated in FIG. 12. In this case, a threaded hole is formed on a peripheral wall of the pole 92. In addition, the first bolt is threadedly engaged with the threaded hole from the outside. A distal end portion of the first bolt is then pressed against an outer surface of the insertion portion 96. Consequently, the pole 92 may be prevented from slipping out from the insertion portion 96. Moreover, a threaded hole may be formed on the peripheral wall of the support portion 98. In addition, the second bolt is threadedly engaged with the threaded hole from the outside. A distal end portion of the second bolt is pressed against the groove 88 of the anchor 84. Consequently, the support portion 98 may be prevented from slipping out from the anchor 84.

Moreover, the distal end portion of the second plunger 100 illustrated in FIG. 12 may be provided with a catch portion (illustration omitted) that is caught on an inner peripheral portion of the support portion 98. In this case, the catch portion and the nut 100*b* sandwich the peripheral wall of the support portion 98. Consequently, the second plunger 100 is fixed to the support portion 98. In this case, there is no need to screw the second plunger 100 into the through-hole 98*a*. Hence, the female thread of the through-hole 98*a* can be omitted.

Fourth Embodiment

Figure 13:
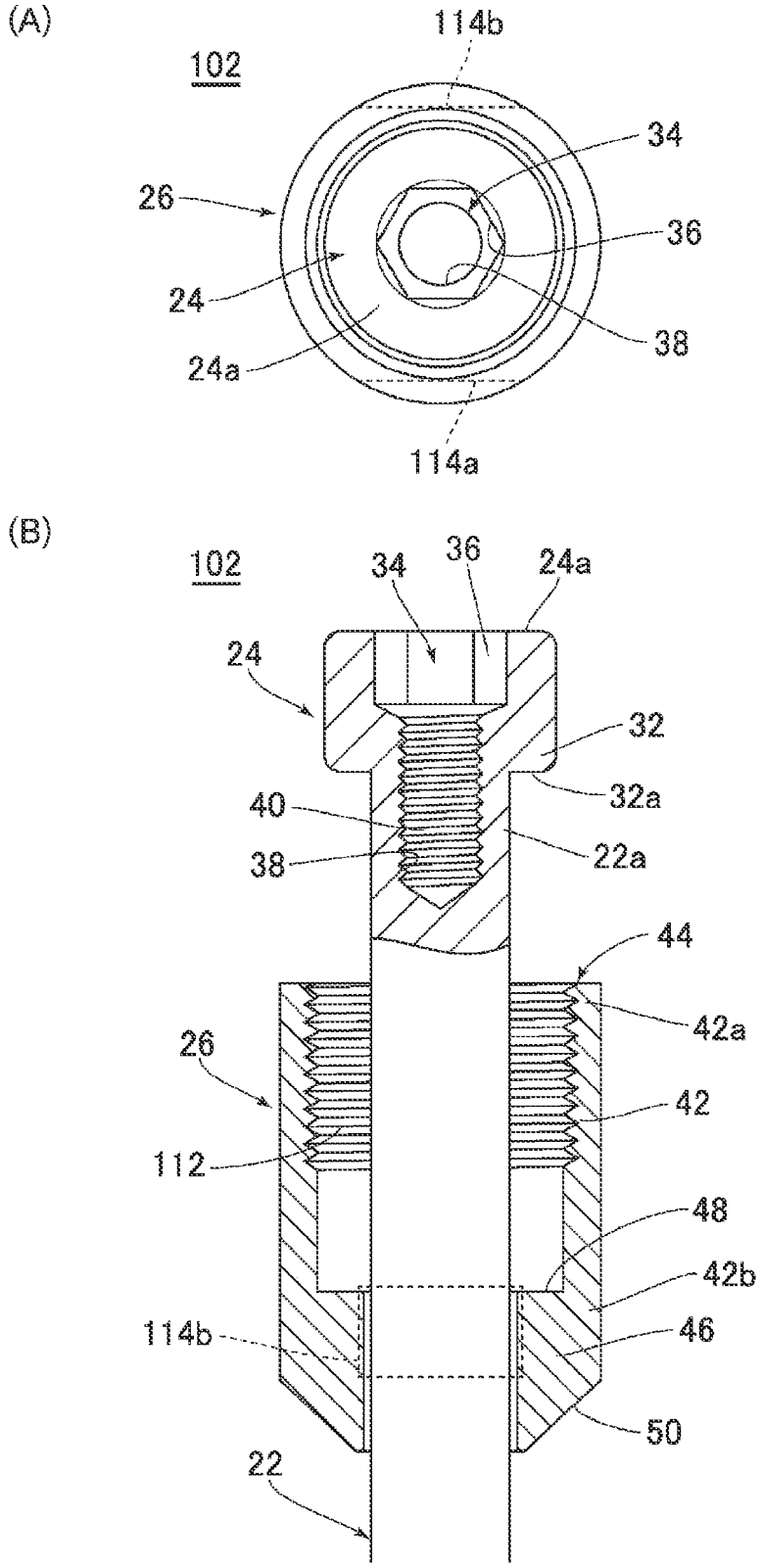
FIG. 13 is diagrams illustrating the configuration of main elements of an anchor according to a fourth embodiment.
Figure 14:
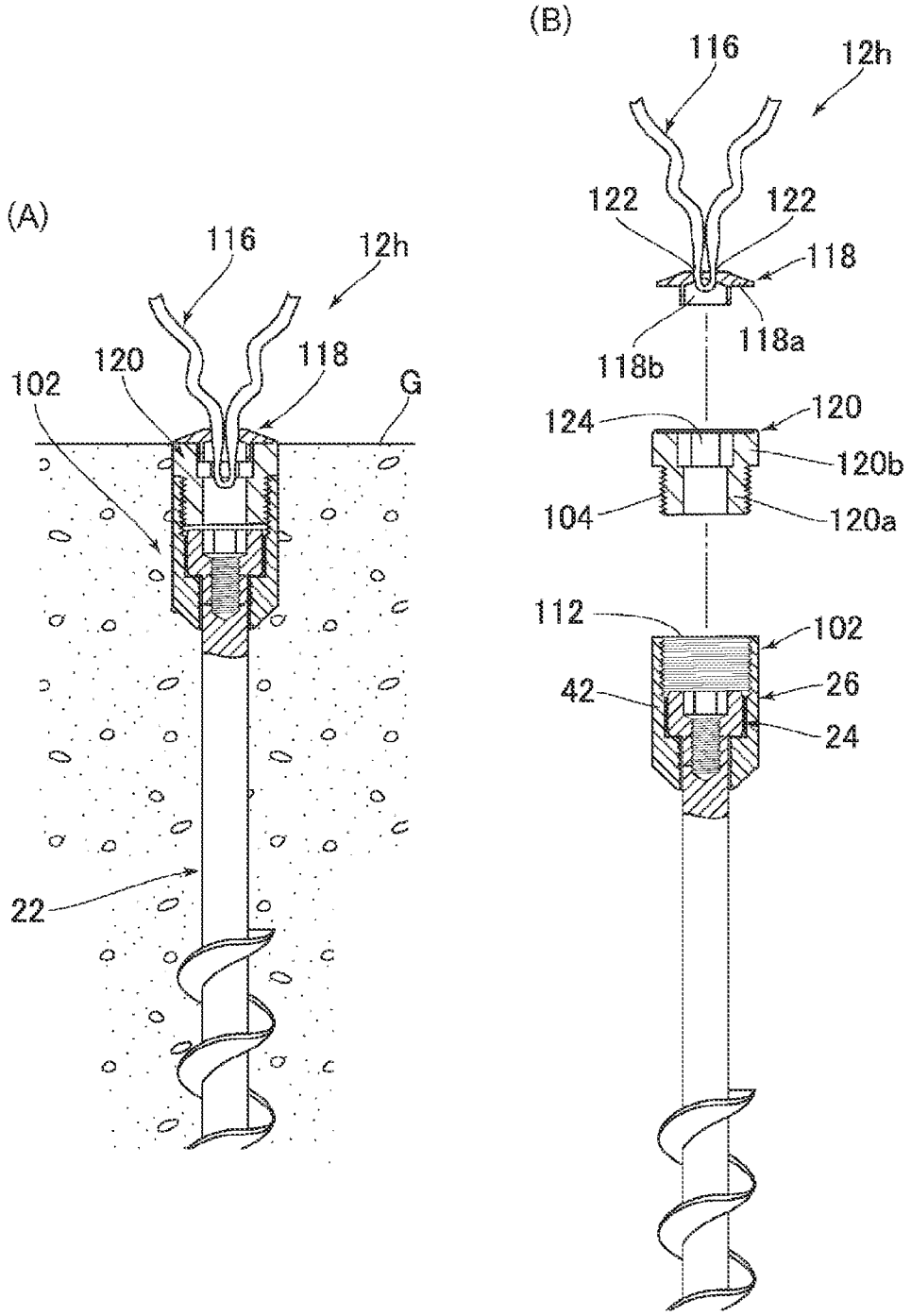
FIG. 14 is diagrams illustrating a first usage state of the anchor according to the fourth embodiment.
Figure 15:
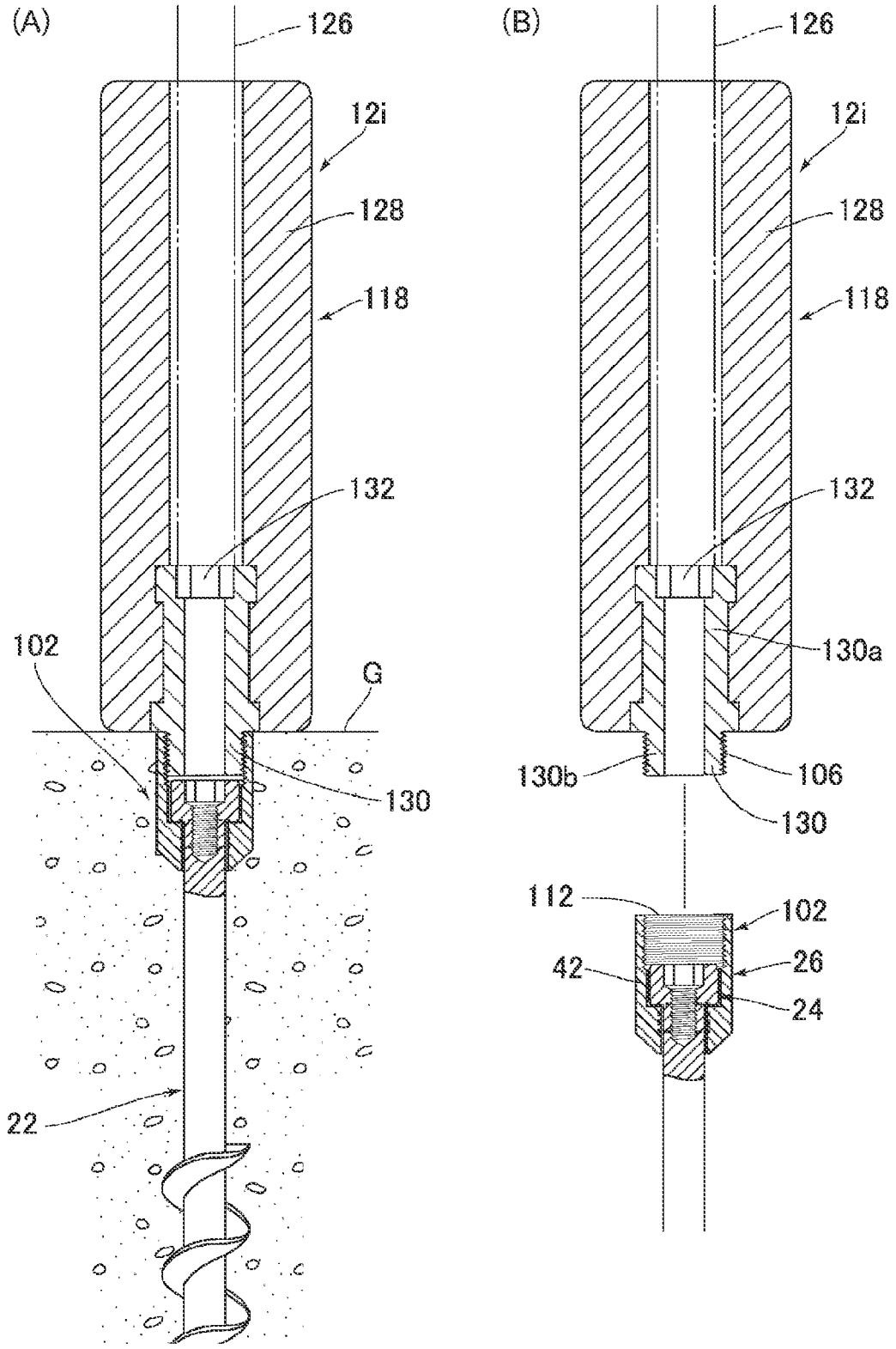
FIG. 15 is diagrams illustrating a second usage state of the anchor according to the fourth embodiment.
Figure 16:
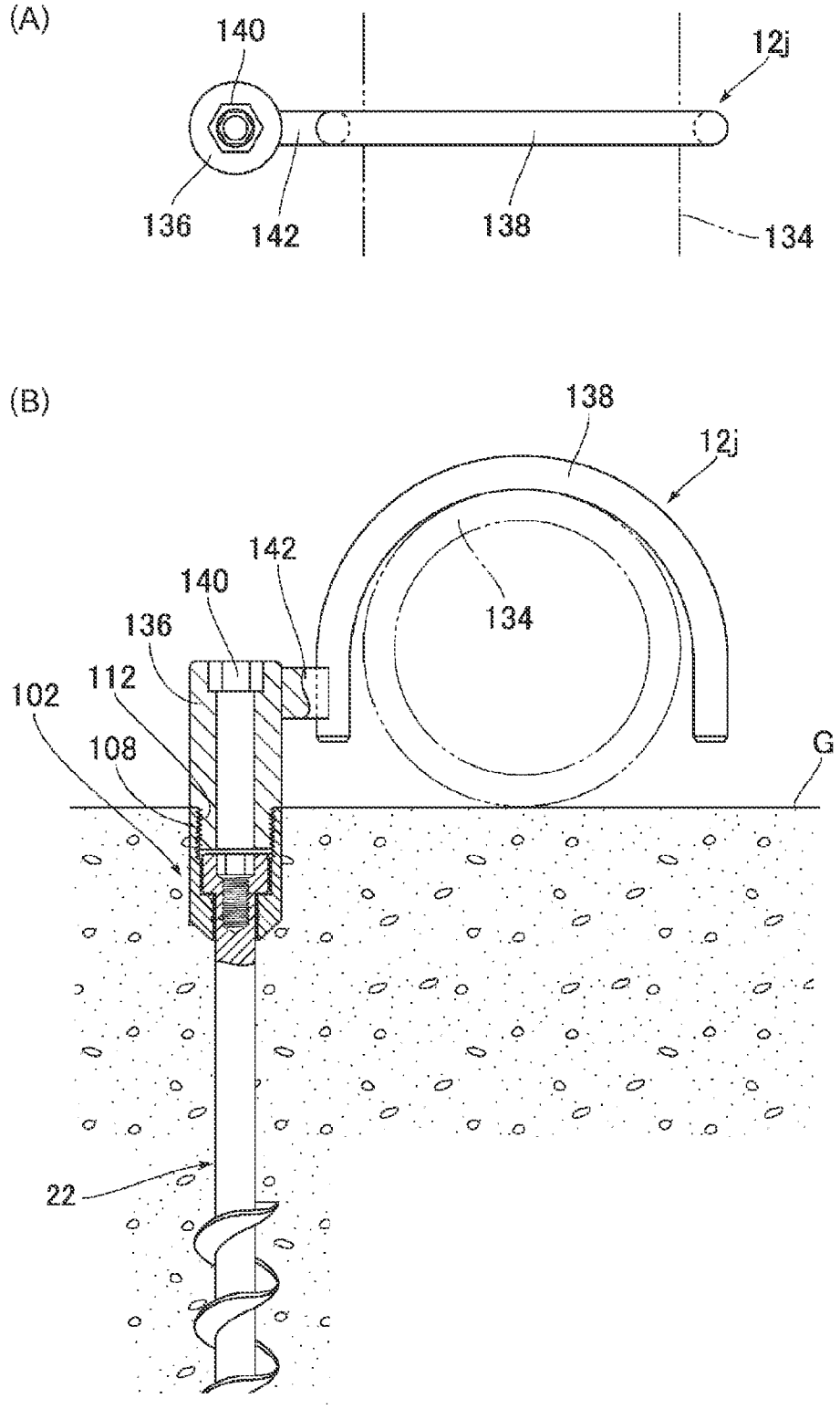
FIG. 16 is diagrams illustrating a third usage state of the anchor according to the fourth embodiment.
Figure 17:
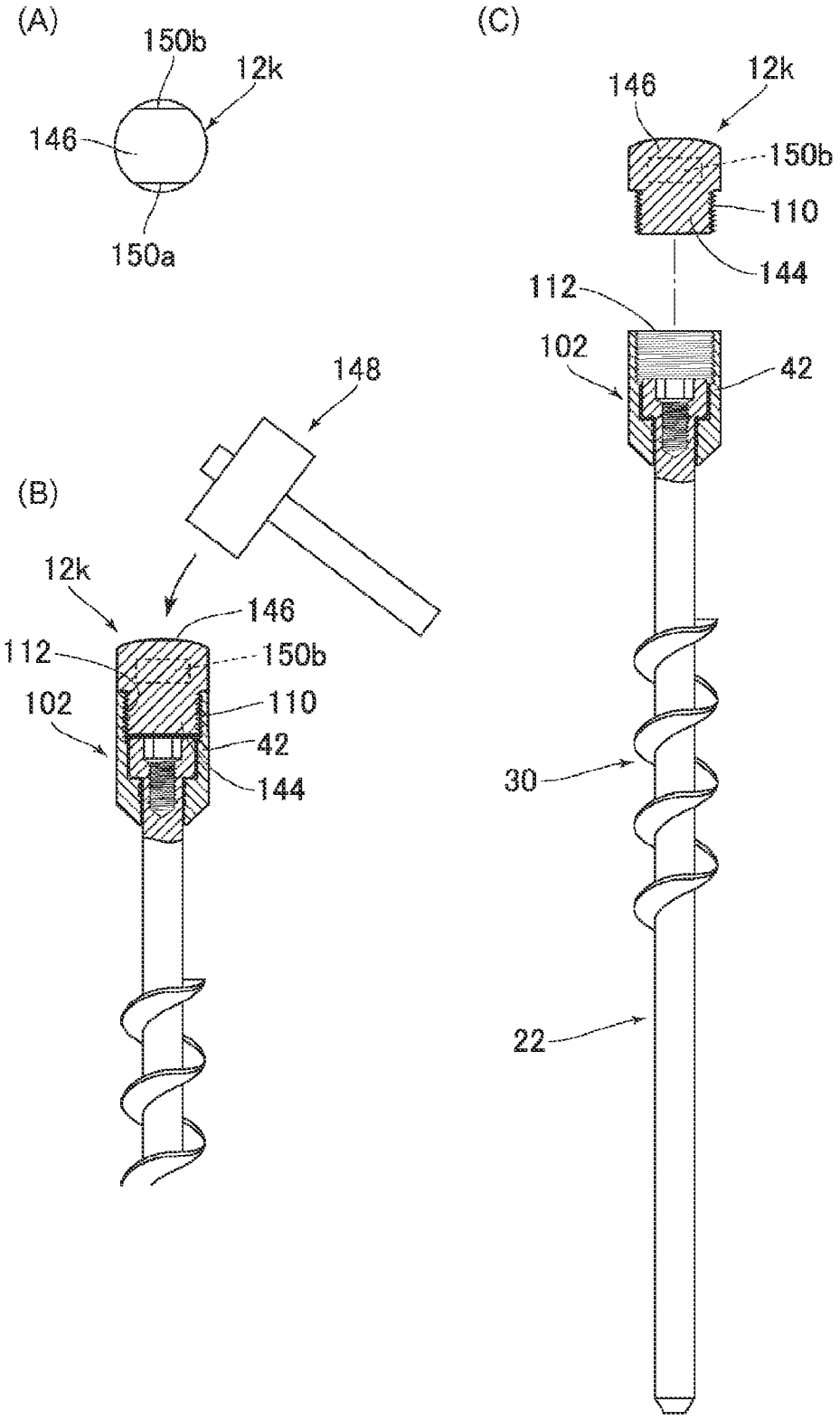
FIG. 17 is diagrams illustrating a fourth usage state of the anchor according to the fourth embodiment.

FIG. 13 is diagrams illustrating the configuration of main elements of an anchor 102 according to a fourth embodiment. FIG. 13(*a*) is a plan view. FIG. 13(*b*) is a front view (partial cross-sectional view). FIG. 14 is diagrams illustrating a first usage state of the anchor 102. FIG. 14(*a*) is a front view (partial cross-sectional view). FIG. 14(*b*) is an exploded front view (partial cross-sectional view). FIG. 15 is diagrams illustrating a second usage state of the anchor 102. FIG. 15(*a*) is a front view (partial cross-sectional view). FIG. 15(*b*) is an exploded front view (partial cross-sectional view). FIG. 16 is diagrams illustrating a third usage state of the anchor 102. FIG. 16(*a*) is a plan view. FIG. 16(*b*) is a front view (partial cross-sectional view). FIG. 17 is diagrams illustrating a fourth usage state of the anchor 102. FIG. 17(*a*) is a plan view. FIG. 17(*b*) is a front view (partial cross-sectional view). FIG. 17(*c*) is an exploded front view (partial cross-sectional view).

In the first embodiment, an inner peripheral surface of the peripheral wall portion 42 of the sleeve 26 forms a smooth curved surface. However, a female thread (second female thread) 112 may be formed on the inner peripheral surface of the peripheral wall portion 42, as in the anchor 102 according to the fourth embodiment illustrated in FIGS. 13(*a*) and 13(*b*). In this case, the female thread (second female thread) 112 is threadedly engaged with a male thread (second male thread) 104, 106, 108, or 110 for joining a fifth fixing target 12*h*, 12*i*, 12*j*, or 12*k* (FIG. 14, 15, 16, or 17) to the sleeve 26 as needed. Moreover, two surfaces 114*a* and 114*b* (FIG. 13(*a*)) parallel to each other, on which a rotary tool (such as a socket wrench) is caught, may be formed on the outer peripheral surface of the peripheral wall portion 42.

In terms of the anchor 102 according to the fourth embodiment, the male thread (second male thread) 104, 106, 108, or 110 is threadedly engaged with the female thread (second female thread) 112. Consequently, the fifth fixing target 12*h*, 12*i*, 12*j*, or 12*k* (FIG. 14, 15, 16, or 17) can be fixed on the ground surface G. In other words, in addition to the above-mentioned "retaining method," "fitting method," "first threaded engagement method," and "mating method," a "second threaded engagement method" for fixing the fifth fixing targets 12*h* to 12*k* can be adopted.

The fifth fixing target 12*h* illustrated in FIGS. 14(*a*) and 14(*b*) is a "ground marker." The "ground marker" includes a marker portion 116, a cap-shaped marker holder 118, and a tubular main body 120. The marker portion 116 has a string form with flexibility, the marker portion 116 being made of a synthetic resin such as nylon. The marker holder 118 includes a plate-shaped portion 118*a* having two through-holes 122 through which the marker portion 116 is passed, and a tubular portion 118*b*. The marker holder 118 is made of a synthetic resin such as nylon. The main body 120 includes a male threaded portion 120*a* and a head 120*b*. The male threaded portion 120*a* includes the male thread (second male thread) 104 that is threadedly engaged with the female thread (second female thread) 112 of the anchor 102. An outer peripheral portion of the head 120*b* is brought into contact with an upper end surface of the peripheral wall portion 42.

A hole 124 that is hexagonal in plan view is formed in the head 120*b*. A rotary tool (such as an impact wrench) is inserted into the hole 124 in the axial direction. The tubular portion 118*b* of the marker holder 118 is then fitted into the hole 124. Consequently, the marker holder 118 is mounted on the main body 120. Note that if the marker portion 116 is not required, the marker portion 116 may be removed from the marker holder 118.

The fifth fixing target 12*i* illustrated in FIGS. 15(*a*) and 15(*b*) is a "pole stand" that supports a pole 126 such as a corner flag. The "pole stand" includes a cylindrical stand body 128, and a male threaded member 130 provided integrally with a lower end portion of the stand body 128. As illustrated in FIG. 15(*b*), the male threaded member 130 includes a buried portion 130*a* buried in the stand body 128, and a protruding portion 130*b* protruding from the lower end portion of the stand body 128. The male thread (second male thread) 106 is formed on an outer peripheral surface of the protruding portion 130*b*. The second male thread 106 is threadedly engaged with the female thread (second female thread) 112 of the anchor 102. A hole 132 that is hexagonal in plan view is formed in an upper end portion of the buried portion 130*a*. A rotary tool (such as an impact wrench) is inserted into the hole 132 in the axial direction.

The fifth fixing target 12*j* illustrated in FIGS. 16(*a*) and 16(*b*) is a "pipe fixing bracket" that fixes a pipe 134. The "pipe fixing bracket" includes a cylindrical bracket body 136, and a semi-circular retainer 138 that retains the pipe 134. The type of the pipe 134 is not particularly limited. A part of a goal post that is placed on a sports ground is assumed as an example. The male thread (second male thread) 108 is formed on an outer peripheral surface of a lower end portion of the bracket body 136. The second male thread 108 is threadedly engaged with the female thread (second female thread) 112 of the anchor 102. A hole 140 that is hexagonal in plan view is formed in an upper end portion of the bracket body 136. A rotary tool (such as an impact wrench) is inserted into the hole 140 in the axial direction. One end portion of the retainer 138 is then jointed to a side surface of the bracket body 136 via a joint portion 142. In the embodiment, each of the bracket body 136 and the retainer 138 is welded to the joint portion 142. Consequently, the bracket body 136 and the retainer 138 are firmly integrated into a single piece.

The fifth fixing target 12*k* illustrated in FIGS. 17(*a*), 17(*b*), and 17(*c*) is a "dual-purpose marker and hammer driving head." The "dual-purpose marker and hammer driving head" includes a male threaded portion 144 having the male thread (second male thread) 110, and a columnar head 146. The second male thread 110 is threadedly engaged with the female thread (second female thread) 112 of the anchor 102. An outer peripheral portion of the head 146 is brought into contact with the upper end surface of the peripheral wall portion 42. The head 146 is a portion that is driven with a hammer 148 illustrated in FIG. 17(*b*). Two surfaces 150*a* and 150*b* parallel to each other, on which a rotary tool (such as a socket wrench) is caught, are formed on the head 146. Note that when the shaft 22 is propelled by being driven with the hammer 148, the digging blade 30 becomes resistance. Hence, it is desirable that the digging blade 30 be not provided to at least a distal end portion of the shaft 22 as illustrated in FIG. 17(*c*).

Fifth Embodiment

Figure 18:
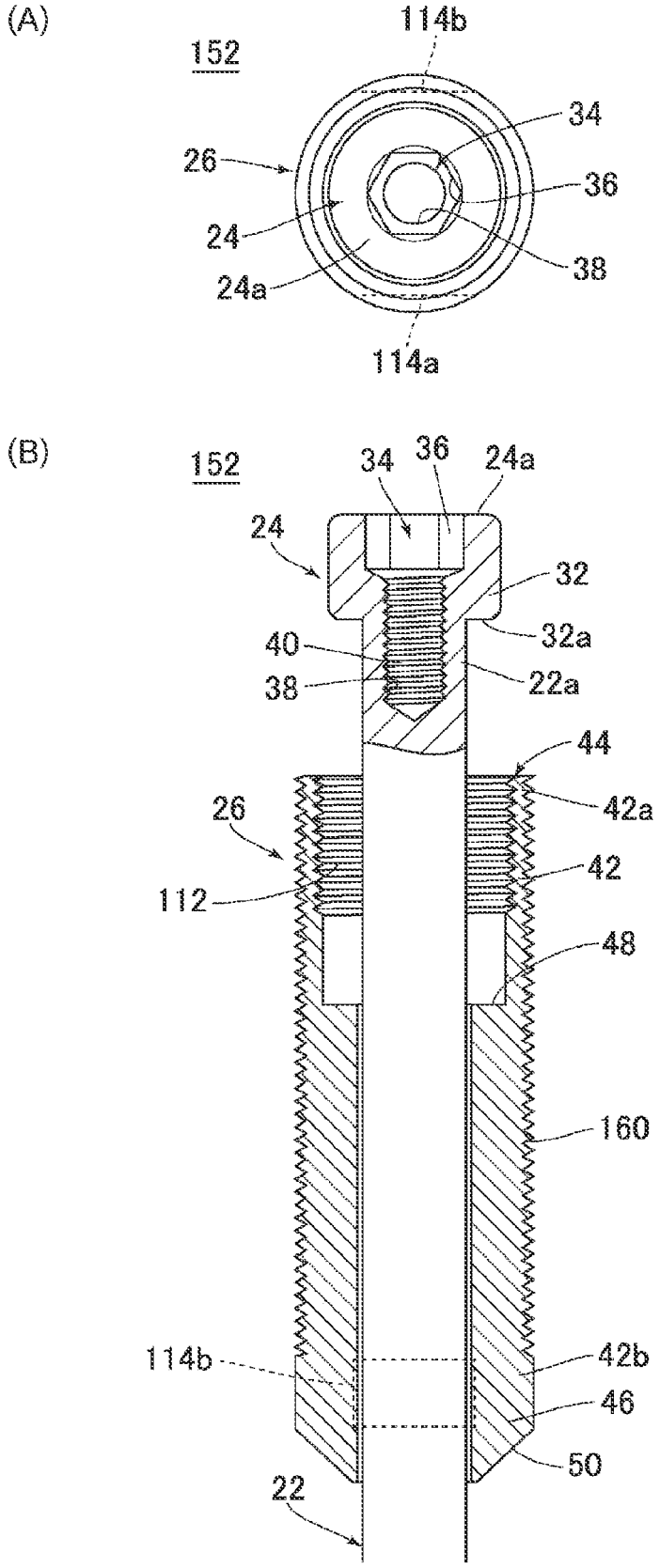
FIG. 18 is diagrams illustrating the configuration of main elements of an anchor according to a fifth embodiment.
Figure 19:
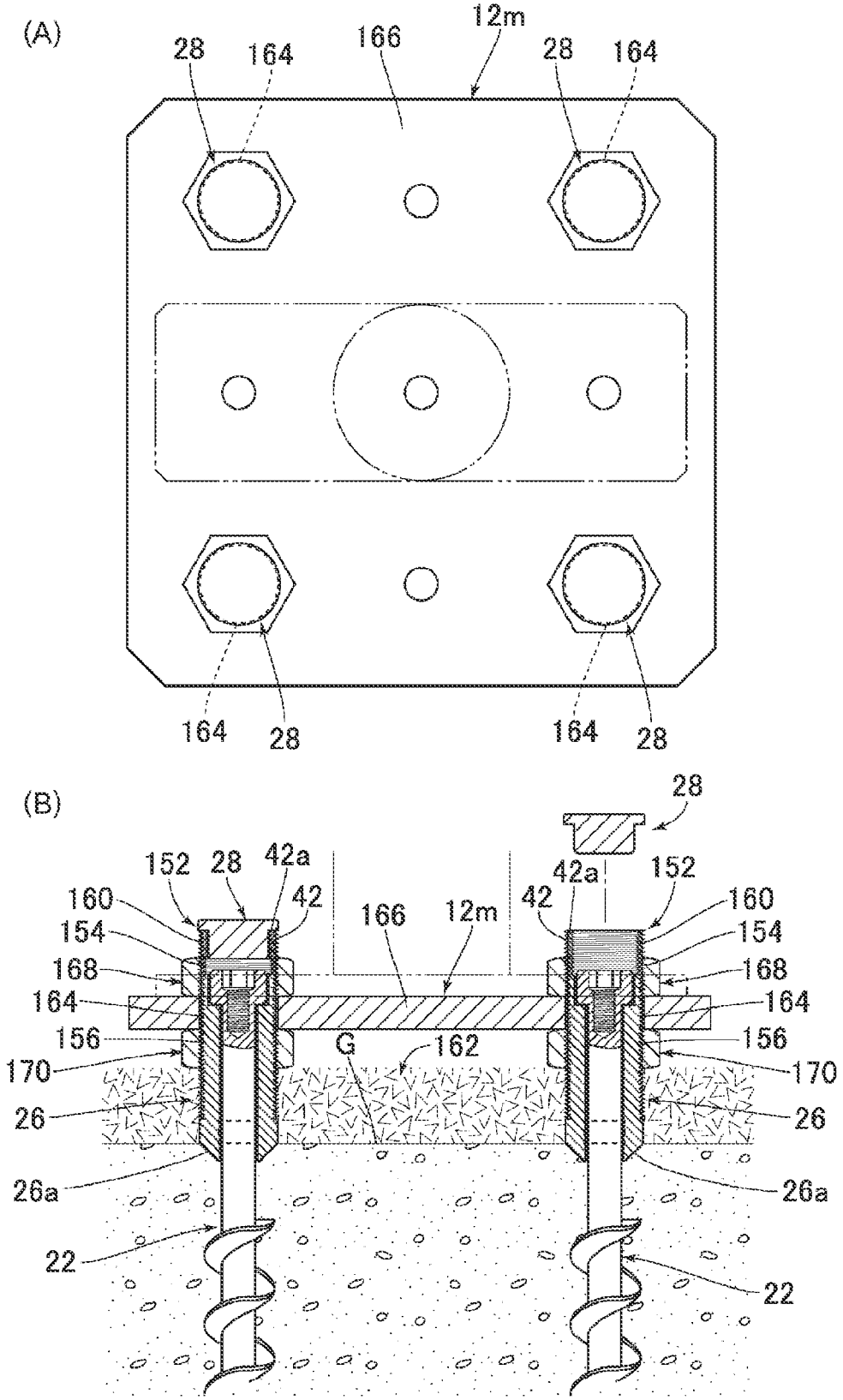
FIG. 19 is diagrams illustrating a first usage state of the anchor according to the fifth embodiment.
Figure 20:
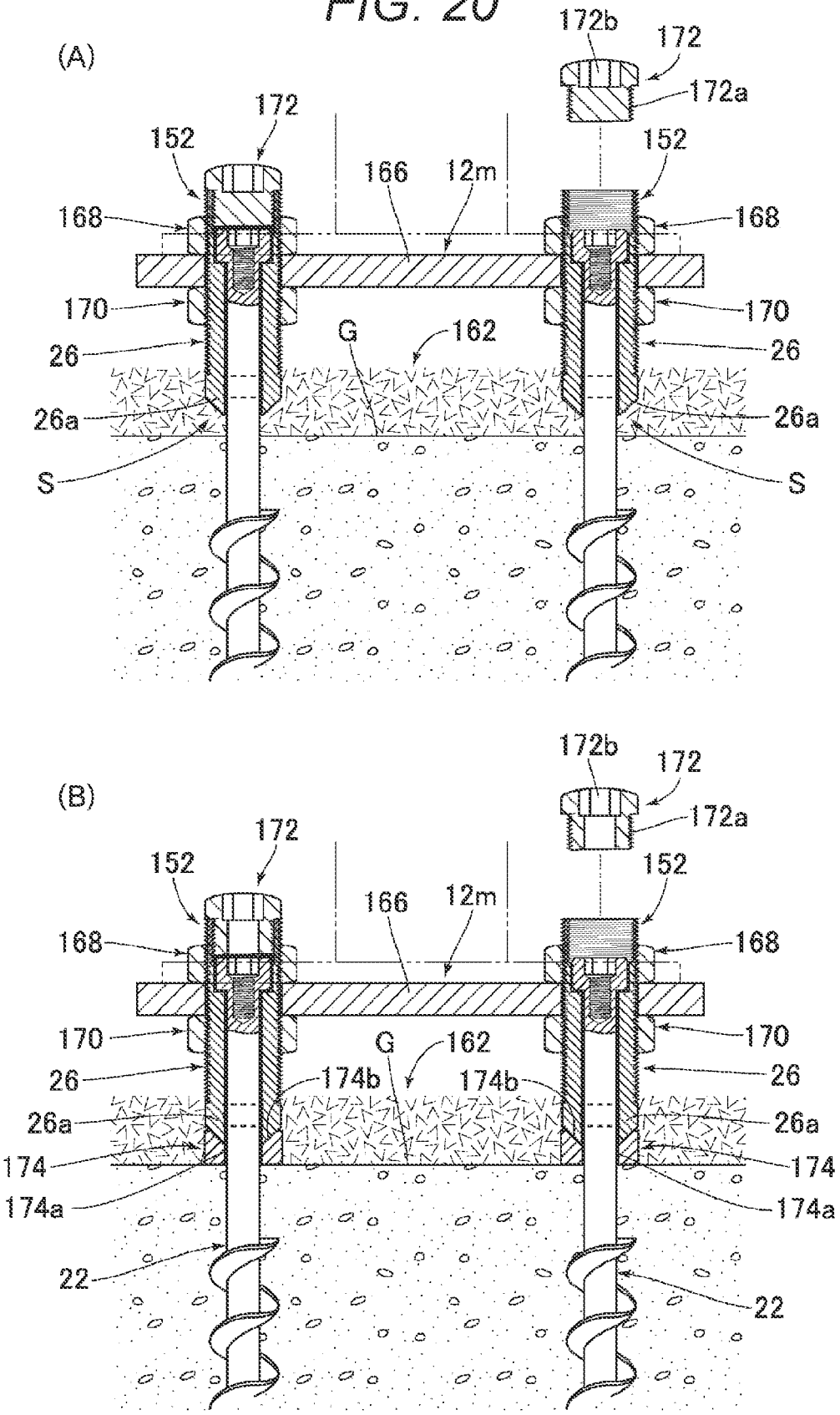
FIG. 20(*a*) is a front view (partial cross-sectional view) illustrating a second usage state of the anchor according to the fifth embodiment.
Figure 21:
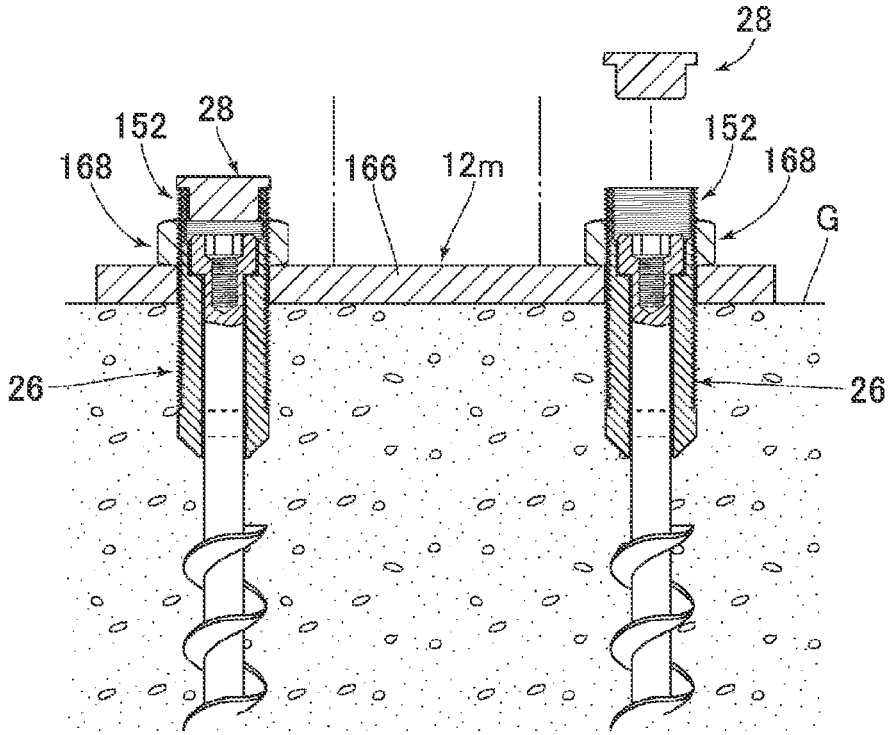
FIG. 21 is a front view (partial cross-sectional view) illustrating a fourth usage state of the anchor according to the fifth embodiment.
Figure 22:
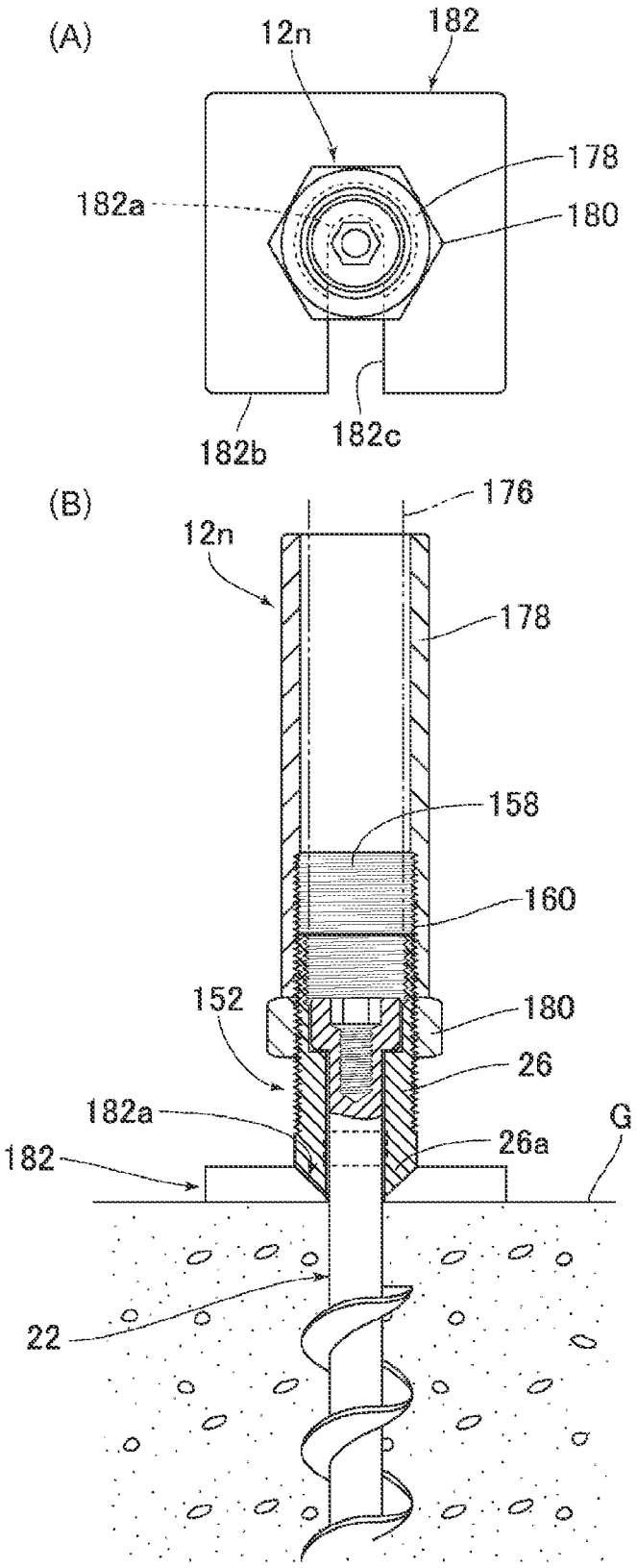
FIG. 22 is diagrams illustrating a fifth usage state of the anchor according to the fifth embodiment.

FIG. 18 is diagrams illustrating the configuration of main elements of an anchor 152 according to a fifth embodiment. FIG. 18(*a*) is a plan view. FIG. 18(*b*) is a front view (partial cross-sectional view). FIG. 19 is diagrams illustrating a first usage state of the anchor 152. FIG. 19(*a*) is a plan view. FIG. 19(*b*) is a front view (partial cross-sectional view). FIG. 20(*a*) is a front view (partial cross-sectional view) illustrating a second usage state of the anchor 152. FIG. 20(*b*) is a front view (partial cross-sectional view) illustrating a third usage state of the anchor 152. FIG. 21 is a front view (partial cross-sectional view) illustrating a fourth usage state of the anchor 152. FIG. 22 is diagrams illustrating a fifth usage state of the anchor 152. FIG. 22(*a*) is a plan view. FIG. 22(*b*) is a front view (partial cross-sectional view).

In the fourth embodiment, the outer peripheral surface of the peripheral wall portion 42 of the sleeve 26 forms the smooth curved surface. However, a male thread (third male thread) 160 may be formed on the outer peripheral surface of the peripheral wall portion 42. Specifically, the male thread (third male thread) 160 may be formed on the outer peripheral surface of the peripheral wall portion 42, as in the anchor 152 according to the fifth embodiment illustrated in FIGS. 18(*a*) and 18(*b*). The third male thread 160 is threadedly engaged with female threads (third female threads) 154, 156, and 158 for joining a sixth fixing target 12*m* (FIGS. 19 to 21) or 12*n* (FIG. 22), which are illustrated in FIGS. 19 to 22, to the sleeve 26 as needed.

In terms of the anchor 152 according to the fifth embodiment, the male thread (third male thread) 160 is threadedly engaged with the female threads (third female threads) 154, 156, and 158. Consequently, the sixth fixing target 12*m* (FIGS. 19 to 21) or 12*n* (FIG. 22) can be fixed on the ground surface G. In other words, in addition to the above-mentioned "retaining method." "fitting method," "first threaded engagement method," "mating method," and "second threaded engagement method," a "third threaded engagement method" for fixing the sixth fixing targets 12*m* and 12*n* can be adopted.

The sixth fixing target 12*m* illustrated in FIGS. 19(*a*) and 19(*b*) is, for example, a leg portion of a board that is placed on a lawn 162. The sixth fixing target 12*m* includes a plate-shaped foundation plate 166 having four through-holes 164. Each of four anchors 152 illustrated in FIG. 19(*b*) includes a first nut 168 having the female thread (third female thread) 154, and a second nut 170 having the female thread (third female thread) 156 in addition to the configuration illustrated in FIGS. 18(*a*) and 18(*b*). Moreover, the cap 28 of the "fitting method" is mounted on the upper end portion 42*a* of the peripheral wall portion 42 of the each of the anchors 152.

When the sixth fixing target 12*m* is fixed, firstly, the shafts 22 of the anchors 152 are buried in the ground. The male threads (third male threads) 160 formed on the peripheral wall portions 42 of the anchors 152 are then threadedly engaged with the female threads (third female threads) 156 of the second nuts 170, respectively. Next, a part of the peripheral wall portion 42 above each of the second nuts 170 is inserted through the respective through-hole 164 of the foundation plate 166 from below. Consequently, the foundation plate 166 is placed on top surfaces of the second nuts 170, and then the male threads (third male threads) 160 are threadedly engaged with the male threads (third male threads) 154 of the first nuts 168, respectively. The first nuts 168 are then pressed against a top surface of the foundation plate 166.

In terms of the anchors 152 illustrated in FIGS. 19(*a*) and 19(*b*), the first nuts 168 can retain the foundation plate 166. Hence, the sixth fixing target 12*m* can be fixed on the ground surface G. At this point in time, the first nuts 168 and the second nuts 170 can sandwich the foundation plate 166. Hence, the sixth fixing target 12*m* can be reliably fixed. Furthermore, the second nuts 170 can receive the foundation plate 166. Hence, the sixth fixing target 12*m* can be fixed, spaced away from the ground surface G.

Note that a lower end portion 26*a* of the sleeve 26 of the each of the anchors 152 illustrated in FIGS. 19(*a*) and 19(*b*) is pressed against the ground surface G. However, a space S may be secured between the lower end portion 26*a* of the sleeve 26 and the ground surface G as illustrated in FIG. 20(*a*). Moreover, a cap 172 of a "screwing method" including a male thread 172*a* and a hole 172*b* into which a rotary tool (such as an impact wrench) is inserted may be used instead of the cap 28 of the "fitting method."

Moreover, a spacer 174 may be provided between the lower end portion 26*a* of the sleeve 26 and the ground surface G as illustrated in FIG. 20(*b*). The spacer 174 is a member having a through-hole 174*a* and a recess 174*b*. The shaft 22 of the anchor 152 is inserted through the through-hole 174*a*. The lower end portion 26*a* of the sleeve 26 is fitted in the recess 174*b*. Moreover, the spacer 174 is formed in a U-shape in plan view. When the spacer 174 is used, the shaft 22 is received into the through-hole 174*a* through the opening, which is open sideward, of the spacer 174. Note that the spacer 174 may be formed in a cylindrical shape. In this case, the spacer 174 is mounted in advance around the shaft 22.

Furthermore, the foundation plate 166 is placed on the top surfaces of the second nuts 170 of the anchors 152 illustrated in FIGS. 19(*a*) and 19(*b*). However, the second nuts 170 may be omitted and the foundation plate 166 may be placed on the ground surface G as illustrated in FIG. 21. Also in this case, the first nuts 168 can retain the foundation plate 166. Hence, the sixth fixing target 12*m* can be reliably fixed on the ground surface G. Note that in this case, the most part of each of the sleeves 26 is buried in the ground.

The sixth fixing target 12*n* illustrated in FIGS. 22(*a*) and 22(*b*) is a "pole stand" that supports a pole 176 such as a corner flag. The "pole stand" includes a cylindrical stand body 178, and a nut 180 provided integrally with a lower end portion of the stand body 178. The female thread (third female thread) 158 is formed on an inner surface of the lower end portion of the stand body 178, and an inner surface of the nut 180. The third female thread 158 is threadedly engaged with the male thread (third male thread) 160 of the anchor 152.

When the sixth fixing target 12*n* is fixed, a base plate 182 is placed between the lower end portion 26*a* of the sleeve 26 of the anchor 152 and the ground surface G as illustrated in FIG. 22(*b*). A through-hole 182*a* is formed in the center of the base plate 182 as illustrated in FIG. 22(*a*). The shaft 22 of the anchor 152 is passed through the through-hole 182*a* in the up-and-down direction. A slit 182*c* is formed between the through-hole 182*a* and a side edge 182*b* of the base plate 182. The through-hole 182*a* is open toward a space on the side of the base plate 182 through the slit 182*c*. An inner peripheral surface of the through-hole 182*a* is formed in a tapered shape having an inner diameter that becomes progressively less toward the downward direction as illustrated in FIG. 22(*b*).

When the base plate 182 is installed between the lower end portion 26*a* of the sleeve 26 and the ground surface G, the shaft 22 of the anchor 152 is passed through the slit 182*c*. Consequently, the shaft 22 is positioned relative to the through-hole 182*a*. In other words, the base plate 182 is positioned relative to the anchor 152. Next, the sleeve 26 of the anchor 152 retains the base plate 182. Consequently, the base plate 182 is fixed, and then the male thread (third male thread) 160 of the anchor 152 is threadedly engaged with the female thread (third female thread) 158 of the sixth fixing target 12*n*. Consequently, the sixth fixing target 12*n* is fixed.

Note that the anchor 152 illustrated in FIGS. 22(*a*) and 22(*b*) is configured in such a manner as to support the pole 176 such as a corner flag via the sixth fixing target 12*n*. However, the anchor 152 can also be configured in such a manner as to directly support the pole 176. In other words, the corner flag itself can be handled as a fixing target. Specifically, a female thread similar to the female thread (third female thread) 158 that is threadedly engaged with the male thread (third male thread) 160 of the anchor 152 is formed in advance on an inner surface of a lower end portion of the pole 176. The female thread of the pole 176 is then threadedly engaged with the male thread (third male thread) 160 of the anchor 152 instead of the sixth fixing target 12*n*. Consequently, the pole 176 can be fixed directly to the anchor 152.

LIST OF REFERENCE NUMBERS

G Ground surface
10, 82, 84, 102, 152 Anchor
12*c*, 12*d*, 12*f* First fixing target
12*a*, 12*b* Second fixing target
12*e* Third fixing target
12*g* Fourth fixing target
12*h* to 12*k* Fifth fixing target
12*m*, 12*n* Sixth fixing target
14 Soccer goal
22 Shaft
24 Head
26 Sleeve
28 Cap
30 Digging blade
34 Tool mounting portion
36 First bottomed hole
38 Second bottomed hole
40 Female thread
42 Peripheral wall portion
44 Opening portion
46 Retainer
48 Opposing surface
50 Retaining surface

The invention claimed is:

1. An anchor that fixes a fixing target on a ground surface, comprising:

a rod-like shaft to be buried in a ground;

a head into which a propulsive force for propelling the shaft in the ground is inputted, the head being provided, coaxially and integrally with the shaft, on an upper end portion of the shaft; and a sleeve including a tubular peripheral wall portion placed around the head, wherein in plan view, a diameter of a first circumcircle circumscribing the head is specified to be greater than a diameter of a second circumcircle circumscribing the shaft, an undersurface facing downward being formed on an outer peripheral portion of the head, the peripheral wall portion is provided in an upper end portion thereof with an opening portion into which a first fixing target is to be fitted above the head, the peripheral wall portion is provided in a lower end portion thereof with a retainer including an opposing surface facing the undersurface formed on the outer peripheral portion of the head from below, and a retaining surface to be pressed against a second fixing target from above, the second fixing target to be fixed on the ground surface, and an inner peripheral surface of the retainer comprises a hole through which the shaft is inserted, and the hole and the opening portion form a through-hole.

2. The anchor according to claim 1, wherein the retaining surface is formed in a tapered shape having an outer diameter that becomes progressively less toward a downward direction.

3. The anchor according to claim 1, wherein the head includes a bottomed hole that is open upward and coaxial with the shaft, and the bottomed hole includes, on an inner peripheral surface thereof, a first female thread to be threadedly engaged with a first male thread for joining a third fixing target to the head.

4. The anchor according to claim 1, wherein the sleeve is configured to be movable in an axial direction relative to the shaft.

5. The anchor according to claim 1, wherein the shaft is provided with a helical digging blade.

6. The anchor according to claim 5, wherein the head is provided with a tool mounting portion on which a rotary tool for rotating the shaft is mounted in the axial direction.

7. The anchor according to claim 1, wherein the peripheral wall portion includes a ring-shaped groove extending in a circumferential direction on an entire circumference of an outer peripheral surface of the peripheral wall portion.

8. The anchor according to claim 1, wherein the peripheral wall portion is provided on the outer peripheral surface thereof with a mating surface to which a fourth fixing target is mated.

9. The anchor according to claim 1, wherein the peripheral wall portion includes, on an inner peripheral surface thereof, a second female thread to be threadedly engaged with a second male thread for joining a fifth fixing target to the sleeve.

10. The anchor according to claim 1, wherein the peripheral wall portion includes, on the outer peripheral surface thereof, a third male thread to be threadedly engaged with a third female thread for joining a sixth fixing target to the sleeve.

11. The anchor according to claim 10, comprising a first nut including the third female thread threadedly engaged with the third male thread, wherein the sixth fixing target includes a plate-shaped foundation plate having a second through-hole, and the peripheral wall portion is inserted through the second through-hole and the first nut is pressed against a top surface of the foundation plate.

12. The anchor according to claim 11, comprising a second nut including the third female thread threadedly engaged with the third male thread, wherein the foundation plate is placed on a top surface of the second nut.

13. The anchor according to claim 2, wherein the second fixing target includes a third through-hole having a tapered inner peripheral surface which is to be in surface contact with the retaining surface.

* * * * *